US010046562B2

(12) United States Patent
Fricke et al.

(10) Patent No.: US 10,046,562 B2
(45) Date of Patent: Aug. 14, 2018

(54) WIDE ARRAY PRINTHEAD MODULE

(71) Applicant: HEWLETT-PACKARD DEVELOPMENT COMPANY, L.P., Houston, TX (US)

(72) Inventors: Peter James Fricke, Corvallis, OR (US); Michael W Cumbie, Albany, OR (US); Scott A Linn, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/518,306

(22) PCT Filed: Oct. 28, 2014

(86) PCT No.: PCT/US2014/062722

§ 371 (c)(1),
(2) Date: Apr. 11, 2017

(87) PCT Pub. No.: WO2016/068888

PCT Pub. Date: May 6, 2016

(65) Prior Publication Data

US 2017/0313059 A1 Nov. 2, 2017

(51) Int. Cl.

| | |
|---|---|
| ***B41J 29/38*** | (2006.01) |
| ***B41J 2/15*** | (2006.01) |
| ***B41J 2/045*** | (2006.01) |

(52) U.S. Cl.

CPC ..... *B41J 2/04541* (2013.01); *B41J 2/0452* (2013.01); *B41J 2/0458* (2013.01);
(Continued)

(58) Field of Classification Search

CPC .. B41J 2/04541; B41J 2/0452; B41J 2/04528; B41J 2/04598; B41J 2/04508
(Continued)

(56) References Cited

U.S. PATENT DOCUMENTS

| | | | |
|---|---|---|---|
| 5,724,077 | A | 3/1998 | Murata |
| 5,815,172 | A | 9/1998 | Moh |

(Continued)

FOREIGN PATENT DOCUMENTS

| | | | |
|---|---|---|---|
| CN | 102196919 | A | 9/2011 |
| JP | 2000-000963 | | 1/2000 |

(Continued)

OTHER PUBLICATIONS

Wang, et al. http://www.eecs.berkeley.edu/~jbokor/Full_text_pubs/4-1.pdf—"Maskless Lithography Using Drop-on-demand Inkjet Printing Method".

*Primary Examiner* — An Do
(74) *Attorney, Agent, or Firm* — HP Inc. Patent Department

(57) ABSTRACT

A wide array printhead module includes a plurality of printhead die, each of the printhead die includes a number of nozzles. The nozzles form a number of primitives. A nozzle firing heater is coupled to each of the nozzles. An application specific integrated circuit (ASIC) controls a number of activation pluses that activate the nozzle firing heaters for each of the nozzles associated with the primitives. The activation pulses are delayed between each of the primitives via internal delays and external delays to reduce peak power demands of the printhead die. The ASIC determines the internal delays within each printhead die.

17 Claims, 13 Drawing Sheets

(52) U.S. Cl.
CPC ..... *B41J 2/04528* (2013.01); *B41J 2/04573* (2013.01); *B41J 2/04596* (2013.01); *B41J 2202/13* (2013.01)

(58) Field of Classification Search
USPC ..... 347/9, 12, 40–42
See application file for complete search history.

(56) References Cited

U.S. PATENT DOCUMENTS

| | | | |
|---|---|---|---|
| 6,322,183 | B1 | 11/2001 | Kubota et al. |
| 6,435,668 | B1 | 8/2002 | Barbour et al. |
| 7,735,948 | B2 | 6/2010 | Walmsley et al. |
| 8,240,806 | B2 | 8/2012 | Fosas et al. |
| 2007/0064055 | A1 | 3/2007 | Silverbrook et al. |
| 2008/0084438 | A1 | 4/2008 | Sheahan et al. |
| 2008/0084453 | A1 | 4/2008 | Sheahan et al. |
| 2009/0079774 | A1 | 3/2009 | Stephenson |
| 2011/0058008 | A1 | 3/2011 | Kasai |
| 2012/0120133 | A1 | 5/2012 | Banerjee et al. |

FOREIGN PATENT DOCUMENTS

| | | | |
|---|---|---|---|
| WO | WO-2013115804 | A1 | 8/2013 |
| WO | WO 2013176661 | | 11/2013 |

WIDE ARRAY PRINTHEAD MODULE

BACKGROUND

Printing devices provide a user with a physical representation of a document by printing a digital representation of a document onto a print medium. The printing devices include a number of printhead die used to eject ink or other printable material onto the print medium to form an image. Printhead die deposit drops of ink onto the print medium using a number of nozzle firing heaters within printhead die. Further, the nozzle firing heaters may boil and eject the ink based on activation pulses.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
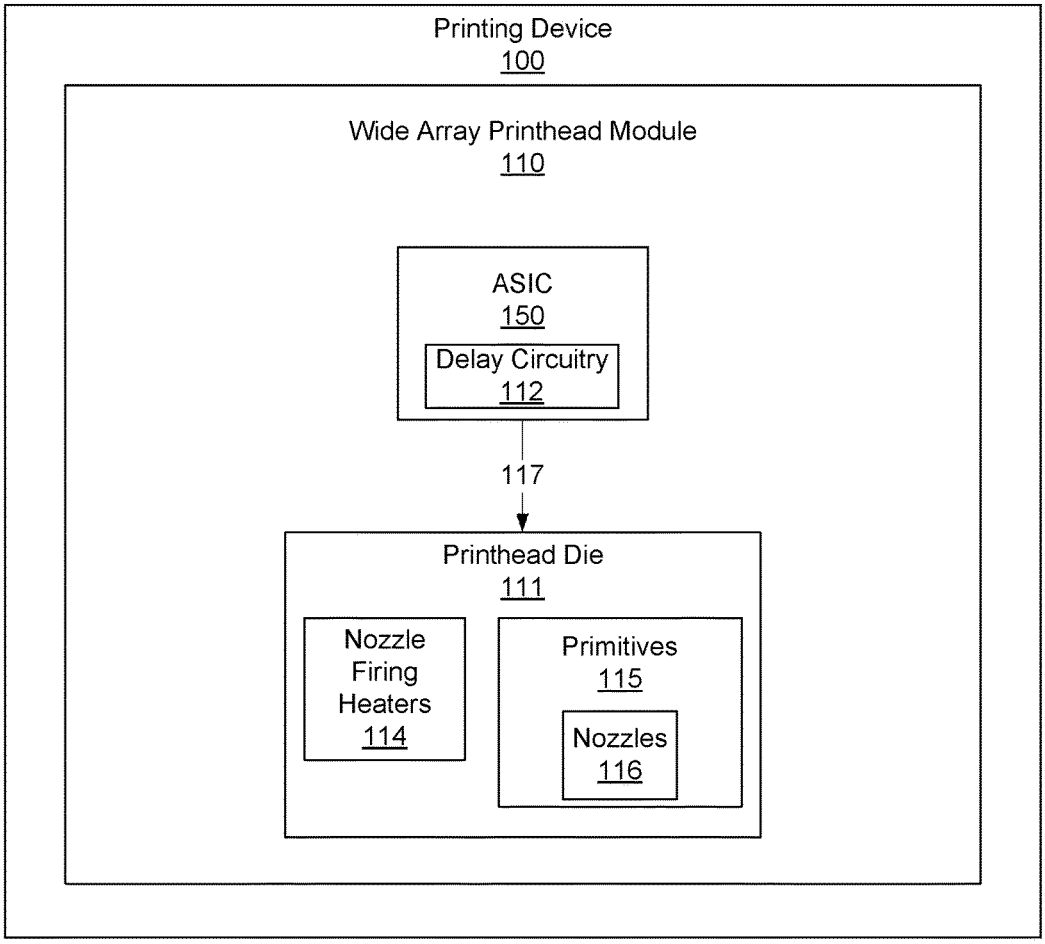
FIG. 1A, is a diagram of a printing device including delay circuitry, according to one example of the principles described herein.

As mentioned above, printhead die deposit drops of ink, via nozzles, onto the print medium using a number of nozzle firing heaters within the printhead die. Further, the nozzle firing heaters may boil and eject the ink based on activation pulses. A printhead die may include thousands of nozzles to eject the ink onto a print medium. Often, activation pulses are received by the nozzle firing heaters to eject the ink out of all the nozzles associated with a printhead die at the same time or approximately the same time. Ejecting the ink out of all of the nozzles at the same time increases coincident transients and ringing on power supply lines of the printhead die. This results in increased peak power demands of the printhead die.

Examples described herein provide a wide array printhead module. The wide array printhead module includes a plurality of printhead die, each of the printhead die include a number of nozzles to eject ink on a print medium. The number of nozzles forming a number of primitives. A nozzle firing heater is coupled to each of the nozzles. An application specific integrated circuit (ASIC) is used to control a number of activation pluses that activate the nozzle firing heaters for each of the nozzles associated with the primitives. The activation pulses are delayed between each of the primitives via internal delays and external delays to reduce peak power demands of the printhead die. The ASIC calibrates the internal delays within each printhead die. Such a wide array printhead module minimizes coincident transients and ringing on power supply lines. As a result, peak power demands of a printhead die are reduced.

As used in the present specification and in the appended claims, the term "primitive" is meant to be understood broadly as a group of nozzles within a printhead die. In an example, a primitive may include 8 nozzles. In another example, a primitive may include 16 nozzles. Further, a printhead die may include a number of primitives.

As used in the present specification and in the appended claims, the term "activation pulse" is meant to be understood broadly as a signal sent to a nozzle firing heater that activates the nozzle firing heater such that ink may be ejected from a nozzle. In an example, the activation pulse may be a single pulse defined by a voltage. In another example, the activation pulse includes a number of precursor pulses and a number of activation pulses. The precursor pulses activate the nozzle firing heater to warm the ink and the activation pulses activate the nozzle firing heater to boil the ink. In yet another example, the activation pulse includes a pulse train that includes a number of activation pulses, the sum of the activation pulses forming a total activation energy. Further, the activation pulse period is further defined by a length of time. The temporal length of an activation pulse is based on the number of nozzles, the number of primitives, a print demand, or combinations thereof.

As used in the present specification and in the appended claims, the term "delay" is meant to be understood broadly as an interval of time in which a next activation pulse is generated with regard to a first activation pulse. In an example, a delay may be an internal delay or an external delay. The internal delays are controlled via analog or digital elements of the printhead die and the external delays are digitally controlled via an ASIC. Additionally, the external delays are defined as delays between the ejections of ink between a plurality of printhead die.

Even still further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

FIG. 1A, is a diagram of a printing device (100) including delay circuitry (112), according to one example of the principles described herein. The printing device (100) includes a number of wide array printhead modules (110). Although one wide array printhead module (110) is depicted in FIG. 1A, any number of wide array printhead modules (110) may be included within the printing device (100).

The wide array printhead modules (110) each include a plurality of printhead die (111), and an application specific integrated circuit (ASIC) (150). Although one printhead die (111) is depicted in FIG. 1A, any number of printhead die (111) including a plurality of printhead die (111) may be included within each of the wide array printhead modules (110).

The ASIC (150), with delay circuitry (112), calibrate a number of internal delays within each printhead die (111) and controls a number of activation pulses (117) sent from the ASIC (150). The activation pulses (117) activate a number of nozzle firing heaters (114) for each of a number of nozzles (116) within the printhead die (111). The nozzles (116) are associated with a number of primitives (115). Although one primitive (115) is depicted in FIG. 1A, any number of primitive (115) may be included within each of the printhead die (111). The primitives (115) are defined as groups of the nozzles (116) within a single printhead die (111). The activation pulses (117) are delayed between each of the primitives (115) via the internal delays and a number of external delays to reduce peak power demands of the printhead die (111) and to minimize coincident transients and ringing on power supply lines.

Figure 1B:
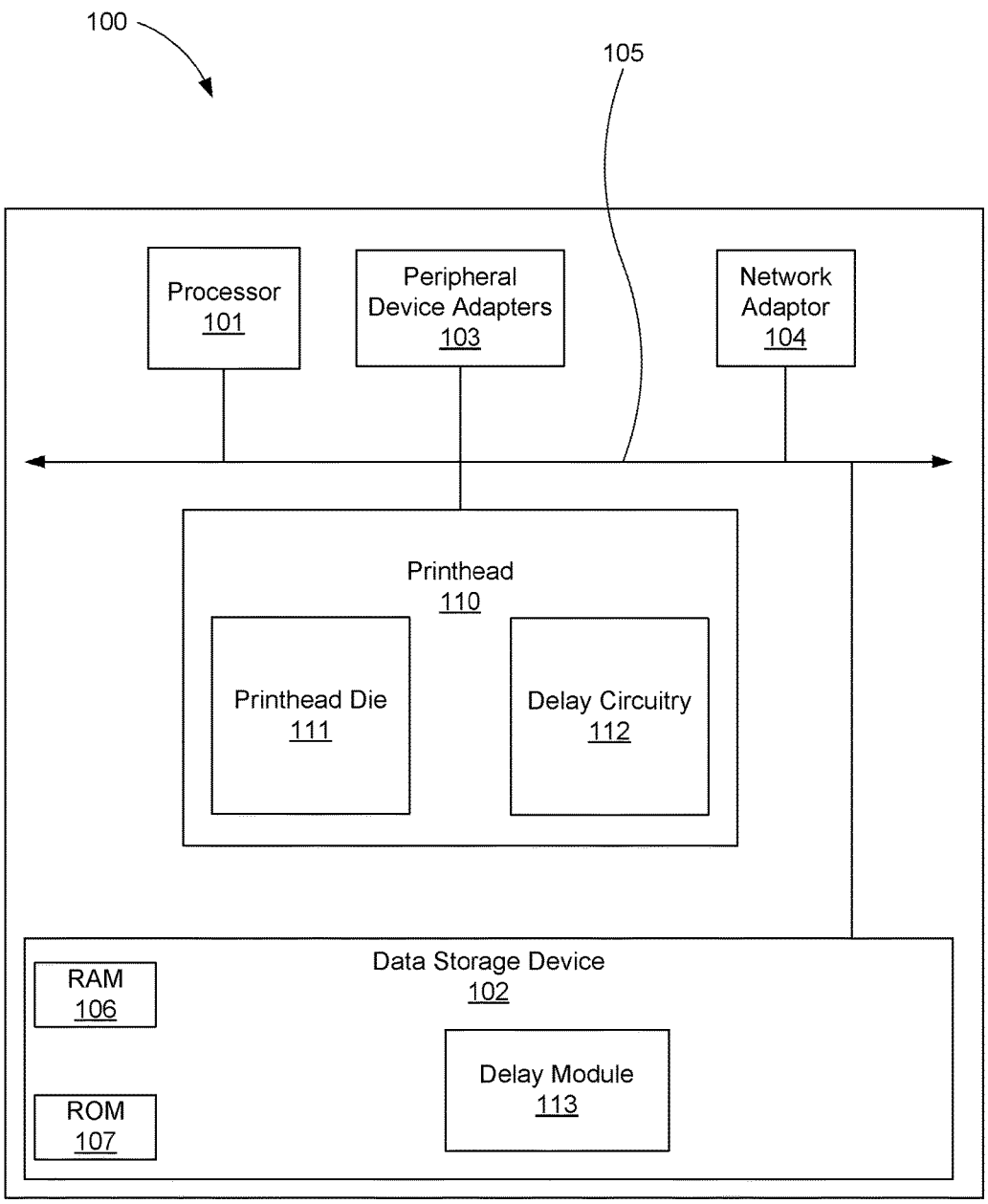
FIG. 1B is a diagram of a printing device including delay circuitry, according to another example of the principles described herein.

FIG. 1B is a diagram of a printing device (100) including delay circuitry (112), according to another example of the principles described herein. The printing device (100) may be implemented in an electronic device. The printing device (100) may be utilized in any data processing scenario including, stand-alone hardware, mobile applications, through a computing network, or combinations thereof. Further, the printing device (100) may be used in a computing network, a public cloud network, a private cloud network, a hybrid cloud network, other forms of networks, or combinations thereof.

To achieve its desired functionality, the printing device (100) includes various hardware components. Among these hardware components may be a number of processors (101), a number of data storage devices (102), a number of peripheral device adapters (103), and a number of network adapters (104). These hardware components may be interconnected through the use of a number of busses and/or network connections. In one example, the processor (101), data storage device (102), peripheral device adapters (103), and a network adapter (104) may be communicatively coupled via a bus (105).

The processor (101) may include the hardware architecture to retrieve executable code from the data storage device (102) and execute the executable code. The executable code may, when executed by the processor (101), cause the processor (101) to implement at least the functionality of determining a first primitive delay of a printhead die before generating a first activation pulse, and generating the first activation pulse for a primitive of the printhead die. The primitive is associated with a number of nozzles defined within the printhead die. The executable code may further cause the processor (101) to implement at least the functionality of activating, via the first activation pulse, a number of nozzle firing heaters coupled to each of the nozzles associated with the primitive based on the primitive delay, and determining a subsequent primitive delay before generating a next activation pulse. The executable code may further cause the processor (101) to implement at least the functionality of generating, based on the subsequent primitive delay, the next activation pulse for a next primitive of the printhead die. The executable code causes the processor (101) to implement its functionality according to the methods of the present specification described herein. In the course of executing code, the processor (101) may receive input from and provide output to a number of the remaining hardware units.

The data storage device (102) may store data such as executable program code that is executed by the processor (101) or other processing device. As will be discussed, the data storage device (102) may specifically store computer code representing a number of applications that the processor (101) executes to implement at least the functionality described herein.

The data storage device (102) may include various types of memory modules, including volatile and nonvolatile memory. For example, the data storage device (102) of the present example includes Random Access Memory (RAM) (106) and Read Only Memory (ROM) (107). Many other types of memory may also be utilized, and the present specification contemplates the use of many varying type(s) of memory in the data storage device (102) as may suit a particular application of the principles described herein. In certain examples, different types of memory in the data storage device (102) may be used for different data storage needs. For example, in certain examples the processor (101) may boot from Read Only Memory (ROM) (107), and execute program code stored in Random Access Memory (RAM) (106).

The data storage device (102) may include a computer readable medium, a computer readable storage medium, or a non-transitory computer readable medium, among others. For example, the data storage device (102) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters (103) in the printing device (100) enable the processor (101) to interface with various other hardware elements, external and internal to the printing device (100). For example, the peripheral device adapters (103) may provide an interface to input/output devices, such as, for example, a user interface, a mouse, or a keyboard. The peripheral device adapters (103) may also provide access to other external devices such as an external storage device, a number of network devices such as, for example, servers, switches, and routers, client devices, other types of computing devices, and combinations thereof.

The peripheral device adapters (103) may also create an interface between the processor (101) and a user interface, another printing device, or other media output devices. The network adapter (104) may provide an interface to other computing devices within, for example, a network, thereby enabling the transmission of data between the printing device (100) and other devices located within the network.

The printing device (100) may, when executed by the processor (101), display the number of graphical user interfaces (GUIs) on a user interface associated with the executable program code representing the number of applications stored on the data storage device (102). The GUIs may display, for example, a number of user-interactive printing options.

The printing device (100) further includes a number of printheads (110) used to eject ink onto a print medium. In one example, the printheads are wide array printhead modules. Although one printhead (110) is depicted in FIG. 1B, any number of printheads may be present within the printing device (100). The printheads (110) operate based on instructions contained within a print job sent from a computing device. The print job contains instructions to print, for example, a document. The processor (101) interprets the print job, and causes the printheads (110) to eject ink onto the print medium such that the document described in the print job is represented on the print medium.

Each of the number of printheads (110) includes a number of printhead die (111). A printhead die (111) may be made from a block of semiconducting material on which the functional circuits described herein are fabricated. In one example, the printhead die (111) is fabricated on a wafer of electronic-grade silicon (EGS) or other semiconductor through processes such as photolithography. Although one printhead die (111) is depicted within the printhead (110) of FIG. 1B, any number of printhead die (111) may be present in the printheads (110) of the printing device (100).

The printing device (100) further includes delay circuitry (112) fabricated into the printhead die (111) of each of the printheads (110). The delay circuitry (112) may assist the printing device (100) in controlling and reducing peak power demands of a printhead die though the delay of firing between primitives within individual printhead die (111) using internal delays, and between different printheads (110) using external delays.

The delay circuitry (112) further assists the ASIC (150) and the processor (101) by determining a first primitive delay of a printhead die before generating a first activation pulse, and generating the first activation pulse for a primitive of the printhead die. The primitive is associated with a number of nozzles defined within the printhead die. The delay circuitry (112) further activates, via the first activation pulse, a number of nozzle firing heaters coupled to each of the nozzles associated with the primitive based on the primitive delay, and determines a subsequent primitive delay before generating a next activation pulse. Further, the delay circuitry (112) generates, based on the subsequent primitive delay, the next activation pulse for a next primitive of the printhead die. The delay circuitry (112) assists the ASIC (150) and the processor (101) according to the methods of the present specification described herein. Without the functionality of the present systems and methods, a reduction in peak power demands of the printhead die (111) would not be realized, and coincident transients and ringing on power supply lines would not be minimized.

The printing device (100) further includes a number of modules used in the implementation of the systems and methods described herein and in printing documents. The various modules within the printing device (100) include executable program code that may be executed separately. In this example, the various modules may be stored as separate computer program products. In another example, the various modules within the printing device (100) may be combined within a number of computer program products; each computer program product including a number of the modules. The printing device (100) may include a delay module (113) to, when executed by the processor (101), control an ASIC to create delays between the firing of primitives within individual printhead die (111), and create delays between the firing of different printheads (110). as described herein.

Figure 1C:
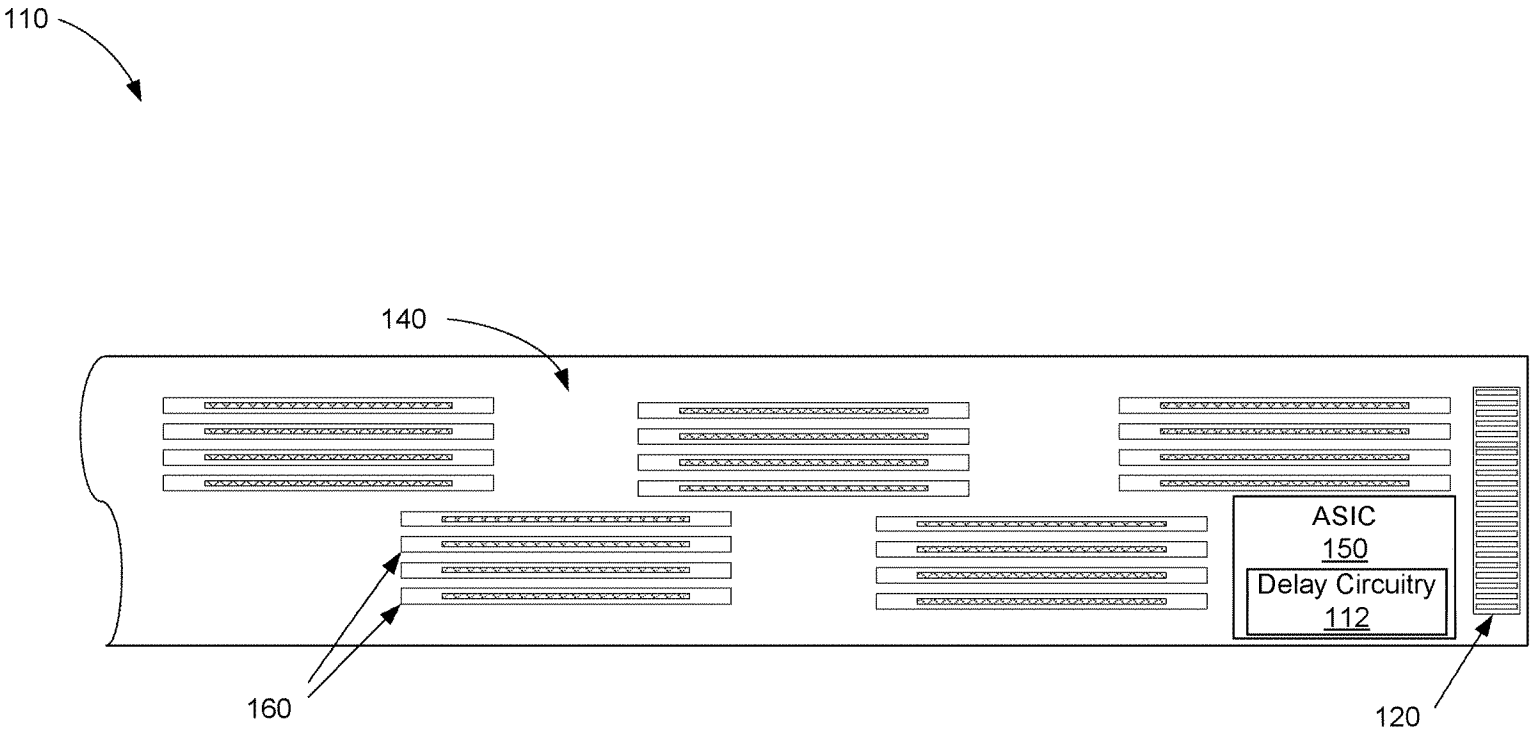
FIG. 1C is a diagram of a wide array printhead module including the delay circuitry of FIGS. 1A and 1B, according to one example of the principles described herein.

FIG. 1C is a diagram of a wide array printhead module, according to one example of the principles described herein. As will be described below, a wide array printhead module may include a number of printhead die integrated on a substrate. Further, each of the printhead die may include a number of nozzles to eject ink based on activation pulses produced by an ASIC and delay circuitry.

The wide array printhead module (100) includes a substrate (140) and a plurality of connections (120) to facilitate data and power transfer. In one example, the wide array printhead module (100) includes a number of printhead die (160). In FIG. 1C, the printhead die (160) are organized into groups of four to facilitate full color printing using three colored inks and black ink. The groups are staggered so as to allow overlap between the columns of jets on the printhead die (160).

In some examples, printhead die (160) with certain inks may be designed optimally using different layer thickness in certain manufacturing processes in order to produce different geometries versus those used for other inks. For example, with black and color ink, a larger drop weight black ink may have a larger height ejection chamber on its die while smaller drop weight colors may have a smaller height ejection chamber on their die. Even so, these color ink printhead die (160) may be built identically on one die, using a thinner layer of polymer in the process for their die as compared to a black printhead die with higher drop weight. In some examples, the printhead die (160) is designed such that it can print an entire page width, eliminating the need for scanning back and forth over the printed surface.

Further, the wide array printhead module (100) includes an ASIC (150). The ASIC (150) may be located on the device in a gap between the groups of printhead die (160). The provision of the ASIC on the substrate (140) may reduce the number of data channels between the printhead die (160)

and a printer. As will be described below, the ASIC (150) controls activation pulses that activate nozzle firing heaters associated with nozzles of each printhead die (160).

In some examples, the ASIC (150) provides temporally delayed activation pulses using the delay circuitry (112) to reduce the peak high voltage power draw from a single printhead die (160). In some examples, the ASIC (150) provides temporally delayed activation pulses to reduce the peak high voltage power draw from the wide array printhead (100) as a whole. This can reduce the costs of physical components in a printer that would otherwise need to be able to provide larger currents.

In some examples, the ASIC (150) is a single device located as shown in FIG. 1C. In other examples, the ASIC (150) is a number of devices mounted to the substrate (140) that control and coordinate operations of the nozzles of the printhead die (160). In this example, these devices are located in the gaps between the groups of printhead die (160).

In some examples, the wide array printhead (100) has additional memory or dedicated thermal controllers located on the wide array printhead (100). More information about the ASIC and activation pulse will be described in other parts of this specification.

Figure 2:
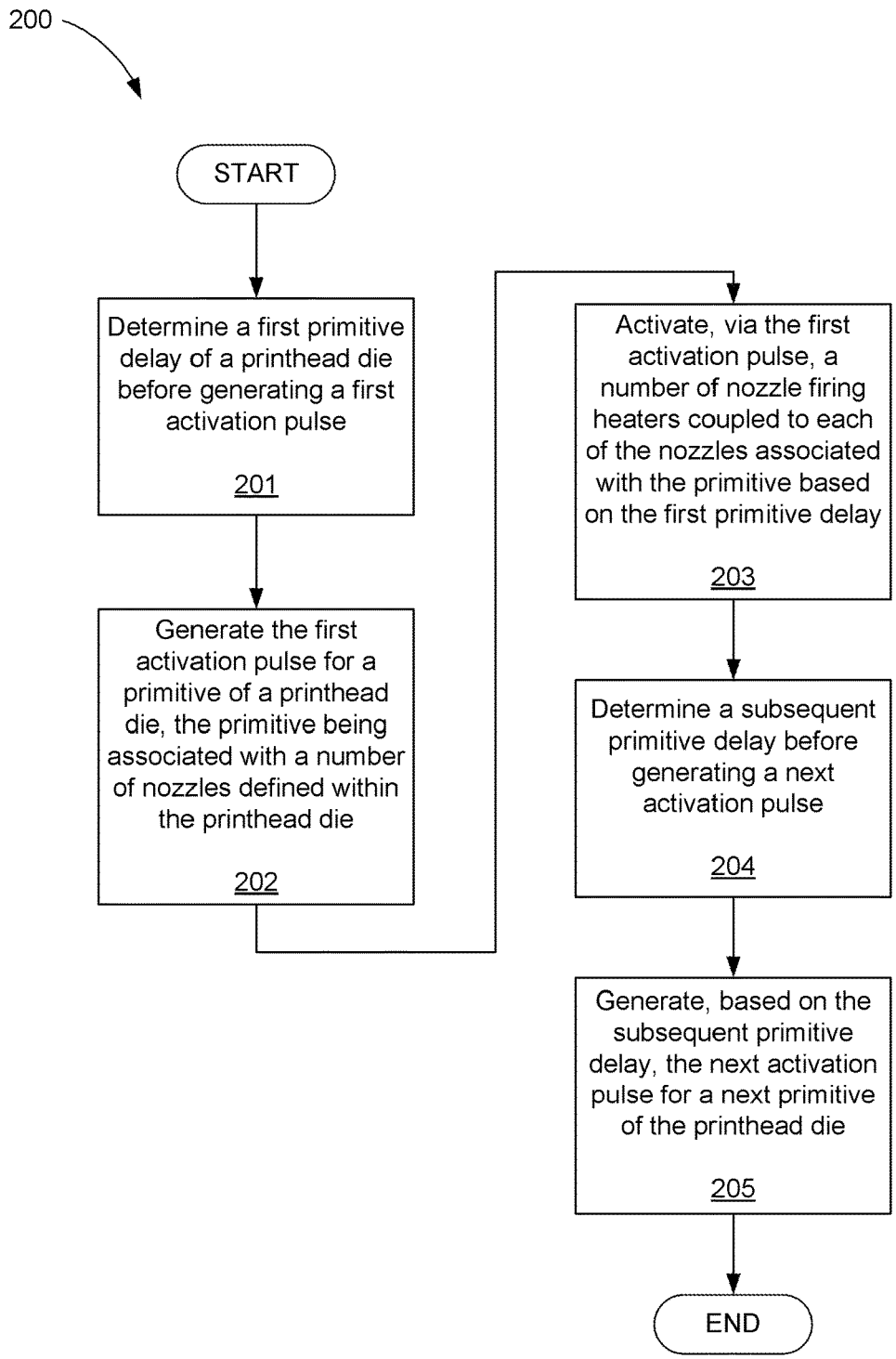
FIG. 2 is a flowchart showing a method of reducing peak power demands of a wide array printhead module, according to one example of the principles described herein.

FIG. 2 is a flowchart showing a method of reducing peak power demands of a wide array printhead module, according to one example of the principles described herein. In one example, the method (200) may be executed by the ASIC of FIG. 1C. In other examples, the method (200) may be executed by other systems and/or devices. The method (200) includes determining (201) a first primitive delay of a printhead die before generating a first activation pulse, and generating (202) the first activation pulse for a primitive of a printhead die, the primitive being associated with a number of nozzles defined within the printhead die. The method further includes activating (203), via the first activation pulse, a number of nozzle firing heaters coupled to each of the nozzles associated with the primitive based on the first primitive delay, and determining (204) a subsequent primitive delay before generating a next activation pulse. The method may continue with generating (205), based on the subsequent primitive delay, the next activation pulse for a next primitive of the printhead die.

As mentioned above, the method (200) includes determining (201) a first primitive delay of a printhead die before generating a first activation pulse. In one example, the first primitive delay of a printhead die may be a delay from a time a print job is activated until a first printhead die receives the first activation pulse. In another example, an ASIC may determine a first primitive delay of a printhead die before generating a first activation pulse.

As mentioned above, the method (200) includes generating (202) the first activation pulse for a primitive of a printhead die, the primitive being associated with a number of nozzles defined within the printhead die. The first activation pulse may be a signal sent from the ASIC (FIG. 1C, 150) to a nozzle firing heater associated with the primitive of the printhead die (FIG. 1C, 160) that activates the nozzle firing heater of the primitive such that ink may be ejected from a nozzle. In an example, the first activation pulse may be a single pulse defined by a voltage. In another example, the first activation pulse includes a number of precursor pulses and a number of activation pulses. The precursor pulses activating the nozzle firing heater to warm the ink and the activation pulses activating the nozzle firing heater to boil the ink. In yet another example, the first activation pulse includes a pulse train that includes a number of activation pulses, the sum of the activation pulses forming a total activation energy. Further, the first activation pulse period is defined by a length of time. The length of the first activation pulse is based on the number of nozzles, the number of primitives, a print demand, or combinations thereof. In some examples, an ASIC (FIG. 1C, 150) may generate the first activation pulse for the primitive of the printhead die (FIG. 1C, 160).

As mentioned above, the method (200) includes activating (203), via the first activation pulse, a number of nozzle firing heaters coupled to each of the nozzles associated with the primitive based on the first primitive delay. In an example, the nozzles may be arranged in a row of primitives. Further, each of the nozzles includes a nozzle firing heater. As each of the nozzle firing heater receives the first activation pulse, the nozzle firing heaters may boil and eject the ink based on activation pulse. As a result, if the printhead die includes three primitives, for example, the first activation pulse activates a first primitive's first nozzle via a nozzle firing heater. The first activation pulse then activates a second primitive's first nozzle via a nozzle firing heater. Further, the first activation pulse then activates a third primitive's first nozzle via a nozzle firing heater. Thus, the activation pulse propagates to each primitive and activates a first nozzle in each primitive. The activation pulse may activate the first nozzles in each primitive based on addresses for each of the first nozzles.

As mentioned above, the method (200) includes determining (204) a subsequent primitive delay before generating a next activation pulse. In an example, the subsequent primitive delay may be an interval of time in which a next activation pulse is sent with regard to a first activation pulse. In an example, the subsequent primitive delay may be based on an internal delay or an external delay. Further, the internal delays are controlled via analog or digital elements of the printhead die and the external delays are digitally controlled via the ASIC (FIG. 1C, 150). Additionally, the external delays are defined as delays between the ejections of ink between a plurality of printhead die (FIG. 1C, 160).

As mentioned above, the method (200) includes generating (205), based on the subsequent primitive delay, the next activation pulse for a next primitive of the printhead die (FIG. 1C, 160). As will be described below, the subsequent primitive delay for the next activation pulse is temporally distorted such that the delay reduces the peak power demands of the printhead die by minimizing coincident transients and minimizing ringing on power supply lines. Further, the next activation pulse ejects ink from nozzles associated with the next primitive of the printhead die as described above. Further, the next activation pulse activates a primitive's second nozzle and then propagates to each primitive and activates a second nozzle in each primitive. The next activation pulse may activate the second nozzles in each primitive based on addresses for each of the second nozzles. Subsequent activation pulses continue and when the last nozzle in each primitive is activated the next activation pulse begins again at the first nozzle of each primitive.

As will be described in other parts of this specification, the method (200) repeats for all primitives of the printhead die (FIG. 10, 160). Further, the method (200) may repeat for all printhead die associated with a wide array printhead module.

Figure 3A:
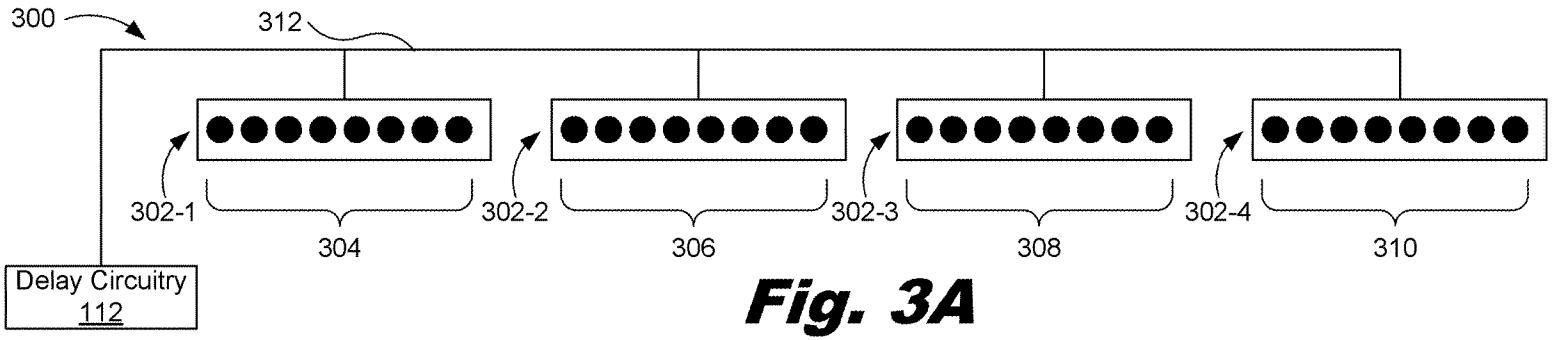
FIG. 3A is a diagram of a number of primitives associated with a number of nozzles, according to one example of the principles described herein.

FIG. 3A is a diagram of a number of primitives (302) associated with a number of nozzles, according to one example of the principles described herein. As will be described below, a printhead die (FIG. 10, 160) may include a number of nozzles. Further, the nozzles may be grouped together to form a number of primitives (302). When each of the primitives receives an activation pulse, nozzle firing heaters activate. The activation of the nozzle firing heaters boils the ink and ejects the ink from the nozzles associated with the primitives onto a print medium.

As depicted in FIG. 3A, a printhead die (300) includes a number of primitives (302). In an example, the printhead die (300) includes a first primitive (302-1), a second primitive (302-2), a third primitive (302-3), and a fourth primitive (302-4). However, any number of primitives may be included within a printhead die and utilized in the manner described herein.

As mentioned above, a primitive is defined as a group of nozzles. As depicted, each of the primitives (302) includes eight nozzles. For example, the first primitive (302-1) includes a first set of eight nozzles (304). The second primitive (302-2) includes a second set of eight nozzles (306). The third primitive (302-3) includes a third set of eight nozzles (308). The fourth primitive (302-4) includes a fourth set of eight nozzles (310).

As will be described in FIG. 3B, activation pulses may be sent, via a bus (312), to each of the primitives (302). The activation pulses activate each of the nozzle firing heaters associated with each set of nozzles (304, 306, 308, 310) for each primitive (302) such that peak power demands of the printhead die (300) are reduced. The delay circuitry (112) of the ASIC (150) is coupled to the bus (312) to determine primitive delays between activation of primitives, and determining delays between the activation of a plurality of printhead die (111). As mentioned above, FIG. 3B depicts a scenario where the printhead die (111) do not utilize the functionality of the delay circuitry (112) in order to contrast this with the application of the delay circuitry (112) within a number of print cycles.

While this example has been described with reference to primitives including eight nozzles, the primitives may include more or less nozzles. For example, each primitive may include four nozzles or sixteen nozzles.

Figure 3B:
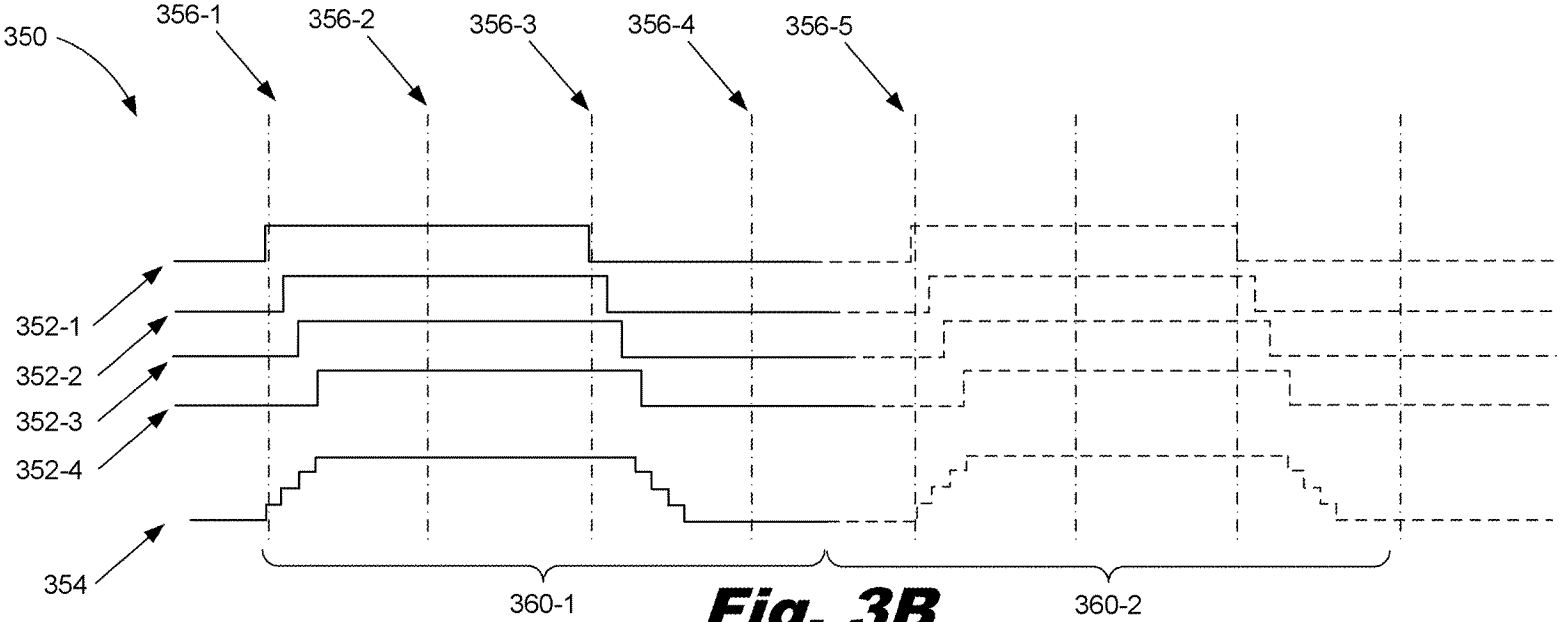
FIG. 3B is a diagram of a timing diagram for firing four primitives without effective delay provided by the delay circuitry of FIGS. 1A through 1C, according to one example of the principles described herein.

FIG. 3B is a diagram of a timing diagram for firing four primitives without effective delay provided by the delay circuitry of FIGS. 1A though 1C, according to one example of the principles described herein. As will be described below, an activation pulse actives a number of nozzle firing heaters for each of a number of nozzles in the primitives of FIG. 3A. Further, the activation pulses heat up the nozzle firing heaters until ink in a chamber of the printhead die (300) is forced out of the nozzle and ejected onto a print medium. FIG. 3B is in contrast to FIG. 4B in that FIG. 3B depicts a timing diagram for firing four primitives without effective delay provided by the delay circuitry (112), whereas FIG. 4B depicts the same but with the benefits of the delay circuitry (112).

As depicted, the timing diagram (350) includes a number of time intervals (356). The timing intervals (356) may be evenly spaced throughout the timing diagram (356). Each of the time intervals represents 650 nanoseconds (nS). For example, time interval one (356-1) represents a start of the timing diagram (350) and time interval two (356-2) represents 650 nS past the start of the timing diagram.

Further, the timing intervals (356) may be used to determine a print cycle. As depicted, the timing diagram includes a first print cycle (360-1). The first print cycle (360-1) may be define as a time from time interval one (356-1) to time interval five (356-5). As will be described below, activation pulses (352) in the first print cycle (360-1) are used to activate first nozzles in each primitive (302). At time interval five (356-5), the print cycle repeats as a second print cycle (360-2). As will be described below, activation pulses (352) in the second print cycle (360-2) are used to activate second nozzles in each primitive (302). Further, subsequent activation pulses continue in subsequent print cycles and when the last nozzle in each primitive is activated a next activation pulse begins again at the first nozzle of each primitive.

As will be described below, the timing intervals (356) may be used to determine a length of activation pulses (352). Further, the timing intervals (356) may be used to determine a delay between each of the activation pulses (352).

As depicted, the timing diagram includes a number of activation pulses (352). As mentioned above, an activation pulse is a signal, such as a voltage, sent from an ASIC (FIG. 1C, 160) to a nozzle firing heater that activates the nozzle firing heater such that ink may be ejected from a nozzle. In an example, the activation pulse may be a single pulse defined by a voltage. In another example, the activation pulse includes a number of precursor pulses and a number of activation pulses. The precursor pulses activate the nozzle firing heater to warm the ink and the activation pulses activate the nozzle firing heater to boil the ink. In yet another example, the activation pulse includes a pulse train that includes a number of activation pulses, the sum of the activation pulses forming a total activation energy. Further, the activation pulse is further defined by a length of time. The length of the activation pulse period is based on the number of nozzles, the number of primitives, a print demand, or combinations thereof. As depicted, the length of the activation pulse (352) is associated with time intervals starting at time interval one (356-1) and ending at time interval (356-3). In an example, the length may be 1.3 microseconds (μS).

As depicted in FIG. 3B, a first activation pulse (352-1) is generated for a first nozzle of the first primitive (302-1) to activate the first nozzle during the first print cycle (360-1). In an example, the first activation pulse (352-1) is associated with a length of time. As mentioned above, the length of the first activation pulse (352-1) is 1.3 μS. Further, the length of the first activation pulse (352-1) is based on eight nozzles per primitive, four primitives per printhead die, a print demand, or combinations thereof as depicted in FIG. 3A.

As mentioned above, the activation pulses (352) are delayed between each of the primitives (302) via the internal delays and a number of external delays to reduce peak power demands of the printhead die (300). As depicted, a second activation pulse (352-2) is generated for a first nozzle of the second primitive (302-2) to activate the first nozzle during the first print cycle (360-1). The second activation pulse (352-2) is temporally delayed from the first activation pulse (352-1). A third activation pulse (352-3) is generated for a first nozzle of the third primitive (302-3) to activate the first nozzle during the first print cycle (360-1). The third activation pulse (352-3) is temporally delayed from the second activation pulse (352-2). Further, a fourth activation pulse (352-4) is generated for a first nozzle of the fourth primitive (302-4) to activate the first nozzle during the first print cycle (360-1). The fourth activation pulse (352-4) is temporally delayed from the third activation pulse (352-3).

Further, the activation pulses (352) in the second print cycle (360-2) are used to activate second nozzles in each primitive (302). Although not depicted, activation pulses in a third, fourth, fifth, sixth, seventh, and eighth print cycle are used to activate third, fourth, fifth, sixth, seventh, and eighth nozzles, respectively, in each primitive (302). After an eighth print cycle has ended, the next activation pulse in the next print cycle is used to activate the first nozzles in each primitive (302). This pattern repeats for subsequent print cycles.

As depicted in the timing diagram (350), the activation pulses (352) may form a die power profile (354). The die power profile (354) defines a current produced by each of the activation pulses (352). As depicted, if one of the activation pulses (352) is active, the die power profile (354) indicates that a factor of one, with regard to current, is activated. If two of the activation pulses (352) are active, the die power profile (354) indicates that a factor of two, with regard to the current, is activated. If three of the activation pulses (352) are active, the die power profile (354) indicates that a factor of three, with regard to the current, is activated. Further, if four of the activation pulses (352) are activated, the die power profile (354) indicates a factor of four, with regard to the current, is activated. As depicted, a die power profile (354) is formed for the first print cycle (360-1) and the second print cycle (360-2).

In an example, if the delay of the activation pulses (352) is minimal, the length of the die power profile (354) includes wasted time between the print cycles. In this example, the first print cycle (360-1) is defined by solid lines depicted in FIG. 3B. Further, the second print cycle (360-2) is defined by dashed lines depicted in FIG. 3B. While the timing diagram (350) depicts the reduction of peak power demands, the delay associated with the activation pulses (352) is ineffective.

Figure 4A:
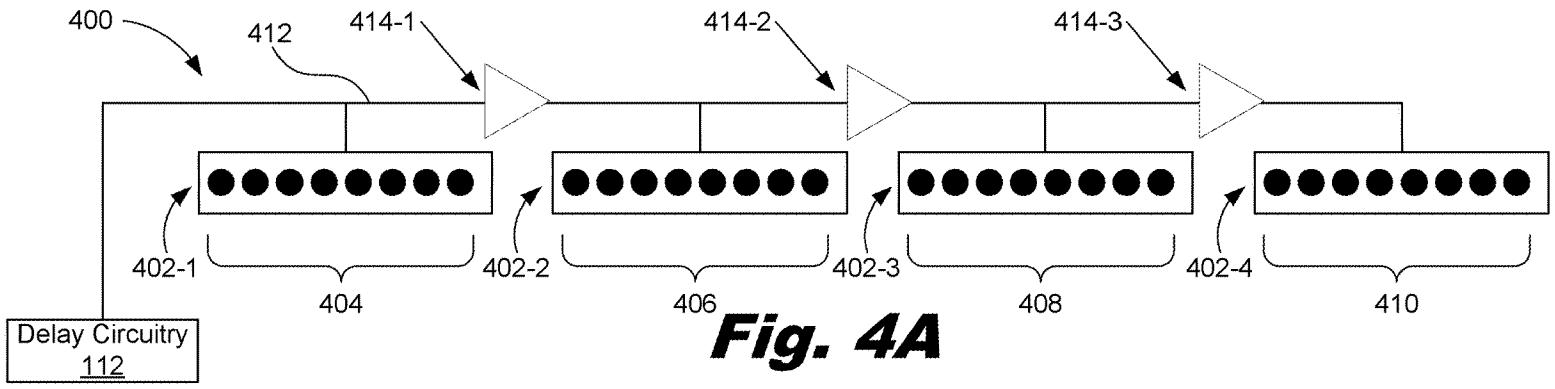
FIG. 4A is a diagram of a number of primitives associated with a number of nozzles with internal delay elements, according to one example of the principles described herein.
Figure 4B:
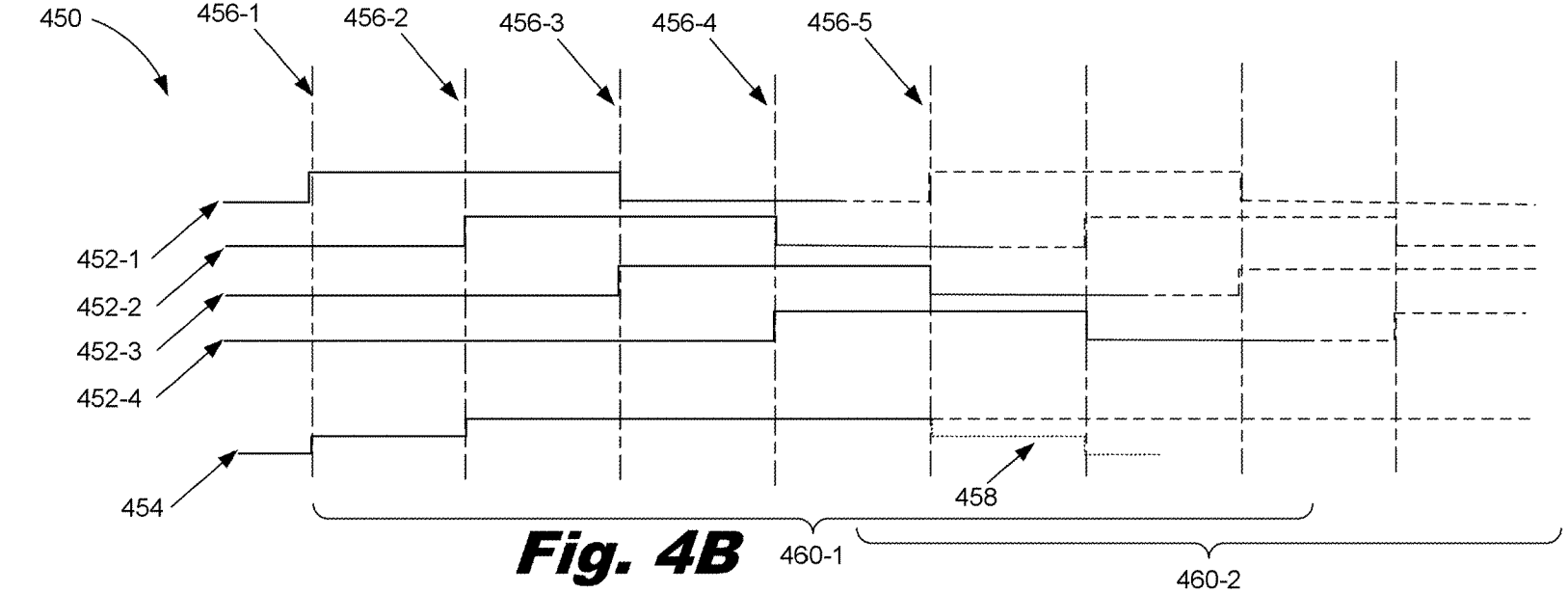
FIG. 4B is a diagram of a timing diagram for firing four primitives with effective internal delay elements, according to one example of the principles described herein.

FIG. 4A is a diagram of a number of primitives associated with a number of nozzles with internal delay elements, according to one example of the principles described herein. As mentioned above, a printhead die may include a number of nozzles. Further, the nozzles may be grouped together to form a number of primitives. When each of the primitives receives an activation pulse, nozzle firing heaters activate. The activation of the nozzle firing heaters boils the ink and ejects the ink from the nozzles associated with the primitives onto a print medium.

As depicted in FIG. 4A, a printhead die (400) includes a number of primitives (402). In an example, the printhead die (400) includes a first primitive (402-1), a second primitive (402-2), a third primitive (402-3), and a fourth primitive (402-4). The delay circuitry (112) of the ASIC (150) is coupled to the bus (412) to determine primitive delays between activation of primitives, and determining delays between the activation of a plurality of printhead die (111) as described above.

As mentioned above, a primitive is defined as a group of nozzles. As depicted, each of the primitives (402) includes eight nozzles. For example, the first primitive (402-1) includes a first set of eight nozzles (404). The second primitive (402-2) includes a second set of eight nozzles (406). The third primitive (402-3) includes a third set of eight nozzles (408). The fourth primitive (402-4) includes a fourth set of eight nozzles (410). As will be described in FIG. 4B, activation pulses may be sent, via a bus (412), to each of the primitives (402) to activate each of the nozzles in the set of nozzles (404, 406, 408, 410) such that peak power demands of the printhead die are reduced.

As depicted, the printhead die (400) includes a number of internal delays (414) coupled to the delay circuitry (112). In one example, the internal delays (414) are controlled via analog elements of the printhead die (400). The internal delays (414) delay the activation pulses between each of the primitives (402) to reduce peak power demands of the printhead die. In an example, a first internal delay (414-1) delays a second activation pulse between the first primitive (402-1) and the second primitive (402-2). The second internal delay (414-2) delays a third activation pulse between the second primitive (402-2) and the third primitive (402-3). Further, the third internal delay (414-3) delays a fourth activation pulse between the third primitive (402-3) and the fourth primitive (402-4). As will be described in FIG. 4B, the internal delays (414) reduce the peak power demand of the printhead die (400) because two primitives are active at the same time instead of three or four primitives (402).

FIG. 4B is a diagram of a timing diagram for firing four primitives with effective internal delay elements, according to one example of the principles described herein. As depicted in FIG. 4B, a first activation pulse (452-1) is generated for a first nozzle of the first primitive (402-1) to activate the first nozzle during a first print cycle (460-1). In an example, the first activation pulse (452-1) is associated with a length. The length of the first activation pulse (452-1) may be 1.3 μS as defined by the time intervals (456). Further, the length of the first activation pulse (352-1) is based on eight nozzles per primitive, four primitives per printhead die, a print demand, or combinations thereof as depicted in FIG. 4A.

As mentioned above, the activation pulses (452) are delayed between each of the primitives (402) via the internal delays (414) and a number of external delays to reduce peak power demands of the printhead die (400). As depicted, a second activation pulse (452-2) is generated for a first nozzle of the second primitive (402-2) to activate the first nozzle during the first print cycle (460-1). The second activation pulse (452-2) is delayed by the first internal delay (414-1). The first internal delay (414-1) delays the second activation pulse (452-2) by 650 nS as defined by the time intervals (456). As a result, the second activation pulse (452-2) is temporally delayed from the first activation pulse (452-1).

As depicted, a third activation pulse (452-3) is generated for a first nozzle of the third primitive (402-3) to activate the first nozzle during the first print cycle (460-1). The third activation pulse (452-3) is delayed by the second internal delay (414-2). The second internal delay (414-1) delays the third activation pulse (452-3) by 650 nS as defined by the time intervals (456). As a result, the third activation pulse (452-3) is temporally delayed from the second activation pulse (452-2).

Further, a fourth activation pulse (452-4) is generated for a first nozzle of the fourth primitive (402-4) to activate the first nozzle during the first print cycle (460-1). The fourth activation pulse (452-4) is delayed by the third internal delay (414-3). The third internal delay (414-3) delays the fourth activation pulse (452-4) by 650 nS as defined by the time intervals (456). As a result, the fourth activation pulse (452-4) is temporally delayed from the third activation pulse (452-3).

Further, the activation pulses (452) in the second print cycle (360-2) are used to activate second nozzles in each primitive (402). Although not depicted, activation pulses in a third, fourth, fifth, sixth, seventh, and eighth print cycle are used to activate third, fourth, fifth, sixth, seventh, and eighth nozzles, respectively, in each primitive (402). After an eighth print cycle has ended, the next activation pulse in the next print cycle is used to activate the first nozzles in each primitive (402). This pattern repeats for subsequent print cycles.

As depicted, the activation pulses (452) may form a die power profile (454). As mentioned above, the die power profile (454) defines a current produced by each of the activation pulses (452). If the delay between the activation pulses (452) is 650 μS, the length of the die power profile (454) does not include wasted time between the print cycles. In this example, the first print cycle (460-1) is defined by solid lines depicted in FIG. 4B. The second print cycle (460-2) is defined by dotted lines depicted in FIG. 4B. Further, an end (458) of the first print cycle (460-1) is defined by a dotted line. As a result, the delay associated with the activation pulses (452) is effective and the peak power demands of the printhead die are reduced. Thus, in the example of FIGS. 4A and 4B, activation pulse 452-1 is high between time intervals 456-1 and 456-2, but the other activation pulses 452-2, 452-3, and 452-4 are low. Activation pulses 452-1 and 452-2 are both high between time intervals 456-2 and 456-3. However, between time intervals 456-3 and 456-4, activation pulse 452-1 goes low, and activation pulse 452-3 goes high. In this manner, only two activation pulses (452) are high at any given time. This reduces the peak power demands of the printhead die (400).

Figure 5A:
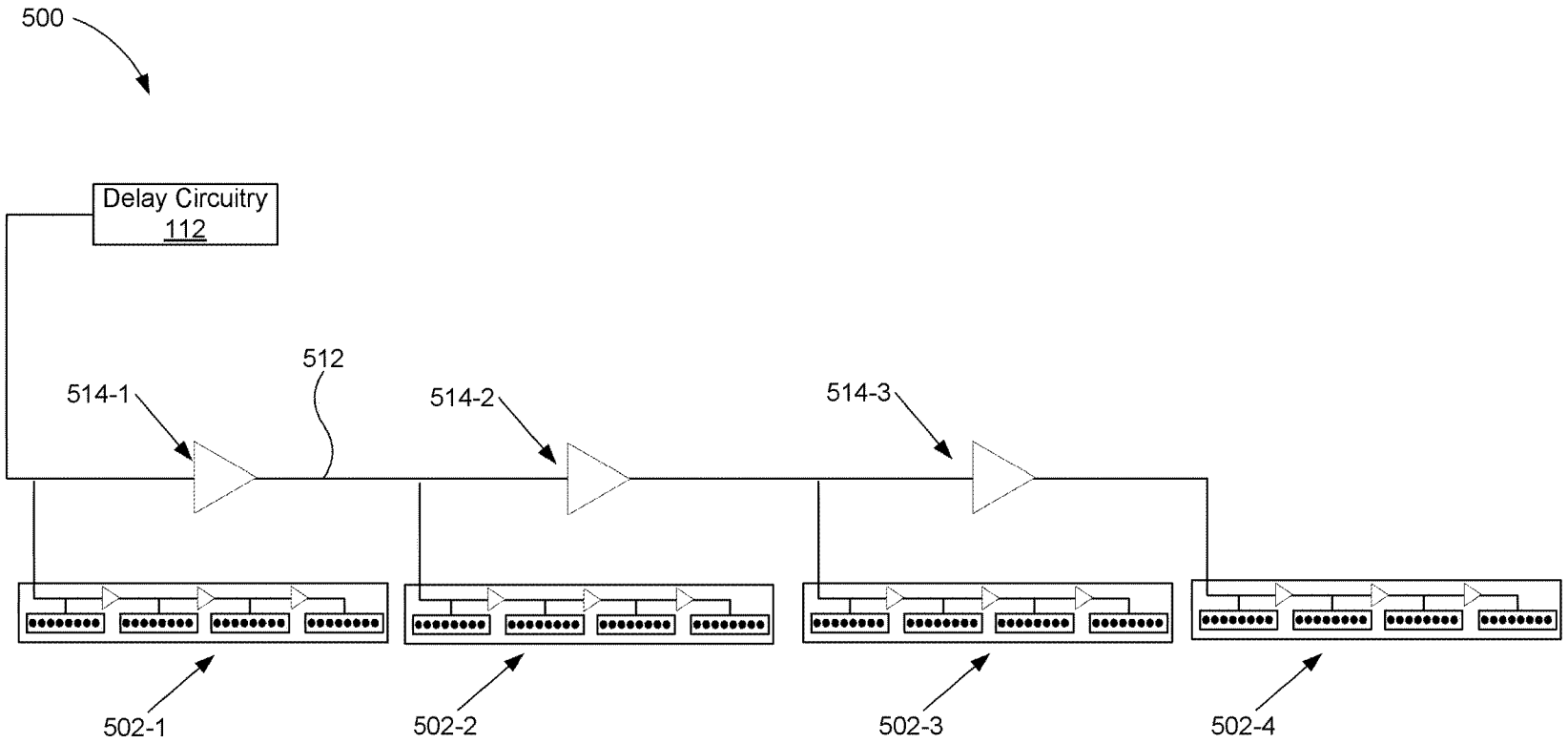
FIG. 5A is a diagram of a number of printhead die with internal delay elements and external delay elements, according to one example of the principles described herein.

FIG. 5A is a diagram of a number of printhead die (502-1, 502-2, 502-3, 502-4) with internal delay elements (FIG. 4, 414) and external delay elements (514), according to one example of the principles described herein. As mentioned above, a wide array printhead module may include a number of printhead die collectively referred to herein as 502. When each of the printhead die receives an activation pulse, nozzle firing heaters activate. The activation of the nozzle firing heaters boils the ink and ejects the ink from the nozzles associated with the printhead die (502) onto a print medium.

As depicted in FIG. 5A, a wide array printhead module (500) includes a number of a printhead die (502). As mentioned above, the printhead die (502) includes a number of primitives (FIG. 4, 402), the primitives being defined as groups of the nozzles. Further, as described above, each of the printhead die (502) may include a number of internal delays.

As depicted in FIG. 5A, the wide array printhead module (500) includes four printhead die (502). For example, the wide array printhead module (500) includes printhead die one (502-1), printhead die two (502-2), printhead die three (502-3), and printhead die four (502-4). As depicted, a number of external delays (514) and the delay circuitry (112) delay an activation pulse between each of the printhead die (502) to reduce peak power demands of the wide array printhead module (500). As will be described in later figures, the external delays (514) are digitally controlled via the ASIC (FIG. 1C, 150). As depicted, a first external delay (514-1) is connected between printhead die one (502-1) and printhead die two (502-2). A second external delay (514-2) is connected between printhead die two (502-2) and printhead die three (502-3). Further, a third external delay (514-3) is connected between printhead die three (502-3) and printhead die four (502-4).

As will be described in FIG. 5B, activation pulses may be sent, via a bus (512), to each of the printhead die (502) to activate each of the primitives such that peak power demands of the wide array printhead module (500) are reduced. The delay circuitry (112) is coupled to the bus (512) in order to send external delay signals to the number of printhead die (502) in addition to sending internal delay signals to primitives within each printhead die (502) as described above in connection with FIGS. 4A and 4B. In this manner, both internal and external delays may be provided to the printhead die (502) and their respective primitives in order to minimize coincident transients and ringing on power supply lines, and reduce peak power demands of the printhead die (502).

While this example has been described with reference to the wide array printhead module including four printhead die (502), the wide array printhead module may include more or less printhead die. For example, the wide array printhead module may include forty printhead die.

Figure 5B:
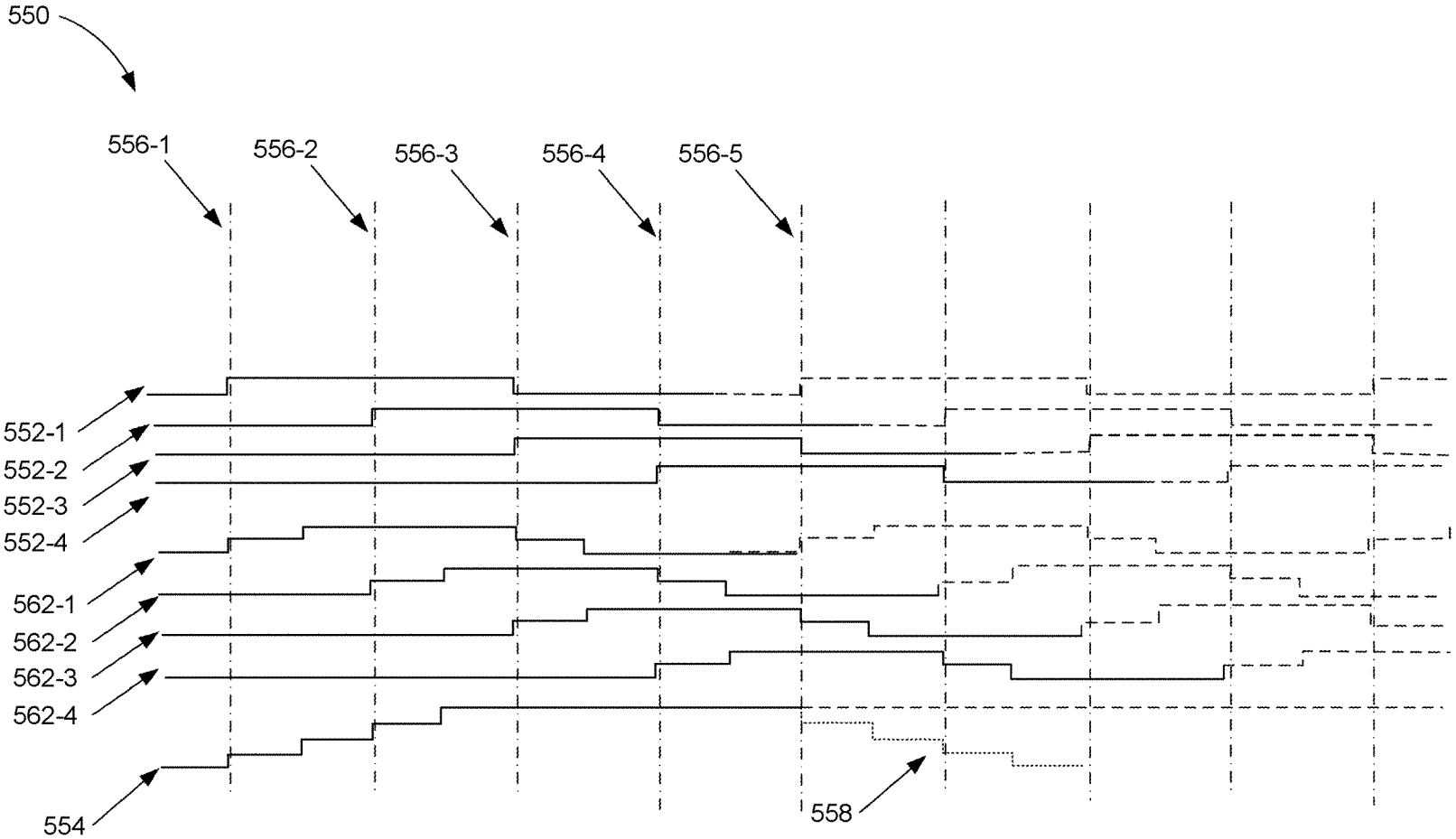
FIG. 5B is a diagram of a timing diagram for firing four printhead die with effective internal delay elements and external delay elements, according to one example of the principles described herein.

FIG. 5B is a diagram of a timing diagram (550) for firing four printhead die (502) with effective internal delay elements and external delay elements, according to one example of the principles described herein. As will be described below, an activation pulse activates a number of nozzle firing heaters for each of a number of nozzles in the printhead die of FIG. 5A.

As depicted in FIG. 5B, a first activation pulse (552-1) is generated for primitives of the first printhead die (FIG. 5A, 502-1) to activate the nozzles associated with the primitives of FIG. 5A as described above. In an example, the first activation pulse (552-1) is associated with a length. The length of the first activation pulse (552-1) may be 1.3 μS as defined by the time intervals (556). Further, the length of the first activation pulse (552-1) is based on eight nozzles per primitive, four primitives per printhead die, a print demand, or combinations thereof as depicted in FIG. 5A. Although not depicted, other activation pulses may be generated for the primitives associated the first printhead die (502-1). Further, the other activation pulses may be temporally delayed, via internal delays as described above. As depicted, the first activation pulse (552-1), as well as other activation pulses associated with the first printhead die (502-1), may form a first die power profile (562-1). The first die power profile (562-1) defines a current produced by each of the activation pulses for the first printhead die (502-1). As a result, the first die power profile (562-1) depicts reduced peak power demands of the first printhead die (502-1).

Further, a second activation pulse (552-2) is generated for primitives of the second printhead die (502-2) to activate the nozzles associated with the primitives of FIG. 5A. As depicted, the length of the second activation pulse (552-2) is the same length as the first activation pulse (552-1). As depicted, the second activation pulse (552-2) is delayed via a first external delay (514-1). As will be described in FIG. 6A, the first external delay (514-1) is generated via the ASIC (FIG. 1C, 150) and delay circuitry (112) within the ASIC. Although not depicted, other activation pulses may be generated for the primitives associated with the second printhead die (502-2). Further, the other activation pulses may be temporally delayed, via internal delays as described above. The first internal delay delays the second activation pulse (552-2) by 650 nS as defined by the time intervals (556). As depicted, the second activation pulse (552-2), as well as other activation pulses associated with the second printhead die (502-2), may form a second die power profile (562-2). The second die power profile (562-2) defines a current produced by each of the activation pulses for the second printhead die (502-2). As a result, the second die power profile (562-2) depicts reduced peak power demands of the second printhead die (502-2).

A third activation pulse (552-3) is generated for primitives of the third printhead die (502-3) to activate the nozzles associated with the primitives of FIG. 5A. As depicted, the length of the third activation pulse (552-3) is the same length as the first activation pulse (552-1). As depicted, the third activation pulse (552-3) is delayed via a second external delay (514-2). As will be described in FIG. 6A, the second external delay (514-2) is generated via the ASIC (FIG. 1C, 150) and the delay circuitry (112) within the ASIC. Although not depicted, other activation pulses may be generated for the primitives associated with the third printhead die (502-3). Further, the other activation pulses may be temporally delayed, via internal delays as described above. The second internal delay delays the third activation pulse (552-3) by 650 nS as defined by the time intervals (556). As depicted, the third activation pulse (552-3), as well as other activation pulses associated with the third printhead die (502-3), may form a third die power profile (562-3). The third die power profile (562-3) defines a current produced by each of the activation pulses for the third printhead die (502-3). As a result, the third die power profile (562-3) depicts reduced peak power demands of the third printhead die (502-3).

The timing diagram (550) further depicts a fourth activation pulse (552-4). The fourth activation pulse (552-4) is generated for primitives of the fourth printhead die (502-4) to activate the nozzles associated with the primitives of FIG. 5A. As depicted, the length of the fourth activation pulse (552-4) is the same length as the first activation pulse (552-1). As depicted, the fourth activation pulse (552-4) is delayed via a third external delay (514-3). As will be described in FIG. 6A, the third external delay (514-3) is generated via the ASIC (FIG. 1C, 150) and the delay circuitry (112) within the ASIC. Although not depicted, other activation pulses may be generated for the primitives associated with the fourth printhead die (502-4). Further, the other activation pulses may be temporally delayed, via internal delays as described above. The third internal delay delays the fourth activation pulse (552-4) by 650 nS as defined by the time intervals (556). As depicted, the fourth activation pulse (552-4), as well as other activation pulses associated with the fourth printhead die (502-4), may form a fourth die power profile (562-4). The fourth die power profile (562-4) defines a current produced by each of the activation pulses for the fourth printhead die (502-4). As a result, the fourth die power profile (562-4) depicts reduced peak power demands of the fourth printhead die (502-4).

The die power profiles (562) may be combined as described above and result in a wide array print head power profile (554). The wide array print head power profile (554) depicts that only two fully active printhead die are active at any given time.

In this example, the first print cycle is defined by solid lines depicted in FIG. 5B. The second print cycle is defined by dotted lines depicted in FIG. 5B. Further, an end (558) of the first print cycle is defined by a dotted line. As a result, the delay associated with the activation pulses (552) is effective and the peak power demands of the printhead die are reduced.

Figure 6A:
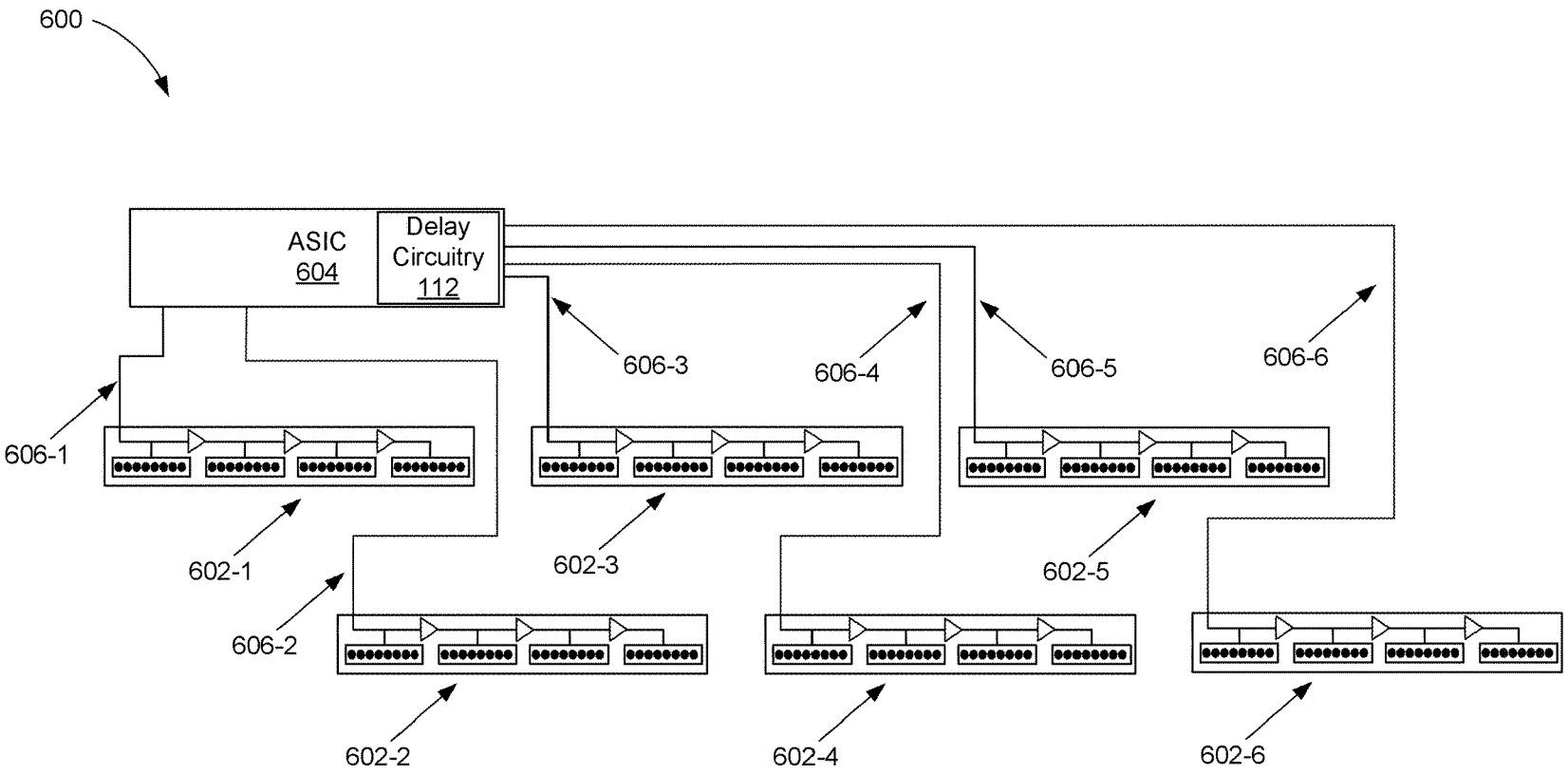
FIG. 6A is a diagram of a number of printhead die controlled by an application specific integrated circuit (ASIC), according to one example of the principles described herein.

FIG. 6A is a diagram of a number of printhead die controlled by an ASIC (604) and the delay circuitry (112) within the ASIC, according to one example of the principles described herein. As will be described below, the ASIC (604) is used to calibrate a number of internal delays within each printhead die and control activation pulses. As mentioned above, the activation pulses activate a number of nozzle firing heaters for each of a number of nozzles, the nozzles being associated with a number of primitives.

As depicted, the wide array printhead module (600) includes an ASIC (604). The ASIC (604) is used to calibrate internal analog delays. In one example, the ASIC (604) configures the printhead die (602) to be calibrated by selecting a mode that enables the ASIC (604) to measure forward and return activation pulse path length. The ASIC (604) sends an activation pulse to the printhead die (602) while in this mode, and determines, within the resolution of the clock, an optimal number of ASIC clock delay units to optimize a delay of a primitive for the printhead die (602). This in turn minimizes the peak system power. After this characterization, and prior to printing, the ASIC (604) configures each printhead by setting a digital register at the resolution of the clock. In normal print operation, each of the printhead die (602) may use an onboard digital to analog converter (DAC) to generate the bias signals to set the internal primitive delay to the programmed value.

In another example, the ASIC (604) is used to calibrate internal analog delays by sending an activation pulse. In this example, a return signal is sent back to the ASIC (604) from the end of the fire line in the printhead die (602). The activation pulse passes through the primitives of the printhead die (602) having a beginning point and a ending point with the internal delays along a bus (606), where each primitive is connected at a delay along the bus (606). The ASIC (604) measures the return delay from the end of the bus (606) and adjusts the control settings for the internal delay using the delay circuitry (112) within the ASIC. The control settings are specific for each printhead die and stored in the printhead die (602) as control bits or voltages to program the internal delay. The ASIC (604), using the delay circuitry (112), adjusts the delay to a target delay and can be based on a counter that is running at high enough frequency to ensure adequate accuracy of the measured and adjusted delay. If the return of the delay is too short, the internal delay is programmed to be longer. If the return of the bus delay is too long, the internal delay is programmed to be shorter. As a result, the calibration is set to within the accuracy of the system. The calibration compensates for process, voltage, and thermal variations. In one example, a default calibration may be used to address the process variation of the components under default voltage and temperature settings. Further, the ASIC (604) may use a field calibration to address voltage and thermal environment in the field.

As depicted in FIG. 6A, a wide array printhead module (600) includes a number of a printhead die (602). As mentioned above, the printhead die (602) includes a number of primitives, the primitives being defined as groups of the nozzles. Further, as described above, each of the printhead die (602) may include a number of internal delays.

As depicted in FIG. 6A, the wide array printhead module (600) includes six printhead die (602). For example, the wide array printhead module (600) includes printhead die one (602-1), printhead die two (602-2), printhead die three (602-3), printhead die four (602-4), printhead die five (602-5), and printhead die six (602-6).

Each of the printhead die (602) is connected, via a bus (606) to the ASIC (604). For example, printhead die one (602-1) is connected to the ASIC (604) via bus one (606-1), printhead die two (602-2) is connected to the ASIC (604) via bus two (606-2), and the remaining printhead die three (602-3, 602-4, 602-5, 602-6) are connected to the ASIC (604) via their respective buses (606-3, 606-4, 606-5, 606-6).

As will be described in FIGS. 6B, 6C, and 6D, activation pulses may be sent, via the buss (606), to each of the printhead die (602) to activate each of the primitives such that peak power demands of the wide array printhead module (600) are reduced.

Figure 6B:
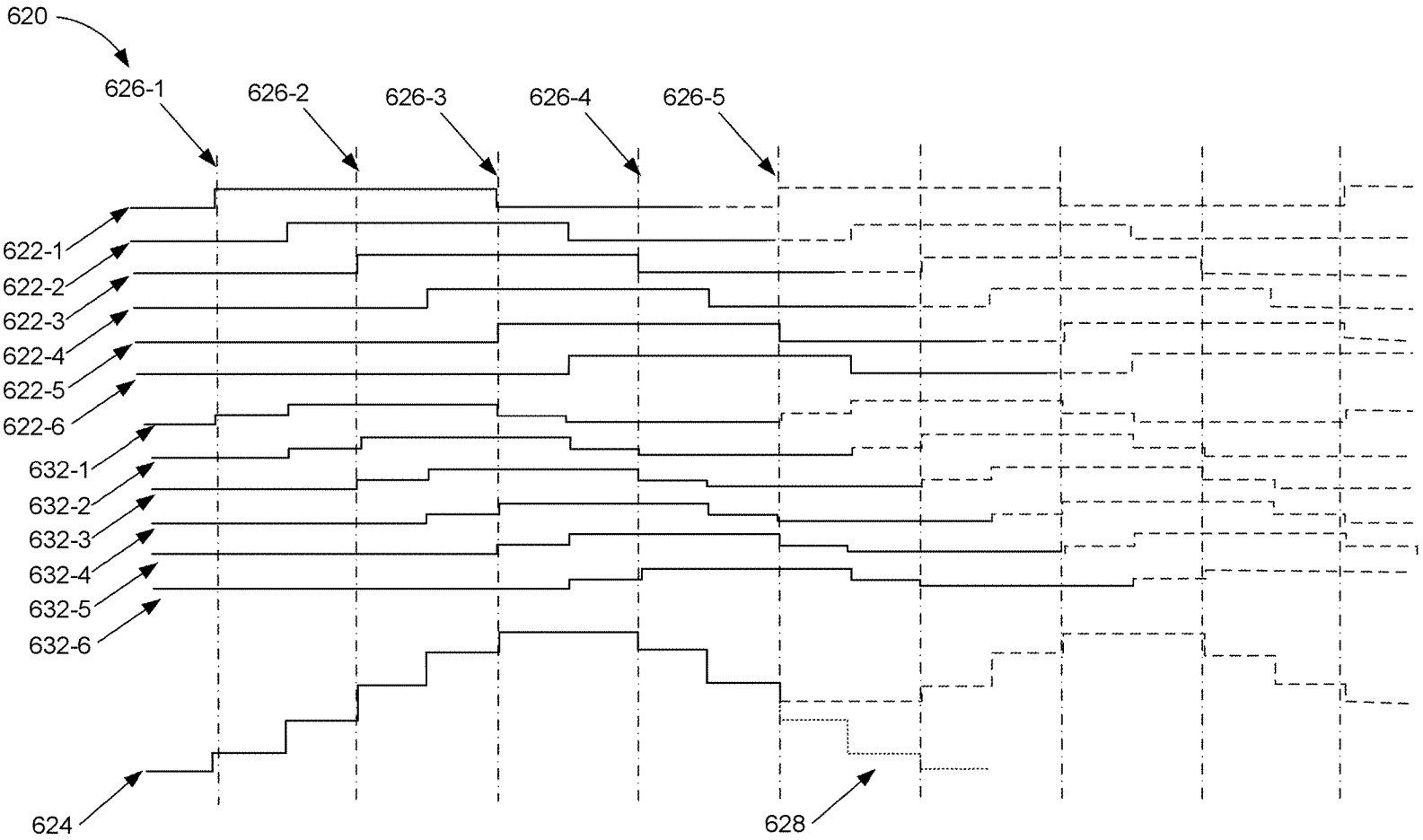
FIG. 6B is a diagram of a timing diagram for controlling a number of printhead die based on a 0.33 microsecond (μS) delay to reduce peak power demands of the printhead die, according to one example of the principles described herein.

FIG. 6B is a diagram of a timing diagram for controlling a number of printhead die based on a 0.33 microsecond (μS) delay to reduce peak power demands of the printhead die, according to one example of the principles described herein. As will be described below, the ASIC (604) of FIG. 6A controls a number of activation pulses to activate nozzle firing heaters for each of the nozzles associated with each of the primitives of the printhead die.

As depicted in FIG. 6B, a first activation pulse (622-1) is generated for primitives of the first printhead die (602-1) to activate the nozzles associated with the primitives of FIG.

6A. The first activation pulse (622-1) may be generated via the ASIC (604) and the delay circuitry (112), and generated for the first printhead die (602-1) via bus one (606-1). In an example, the first activation pulse (622-1) is associated with a length. The length of the first activation pulse (622-1) may be 1.3 μS as defined by the time intervals (626). Further, the length of the first activation pulse (622-1) is based on eight nozzles per primitive, four primitives per printhead die, six printhead die, a print demand, or combinations thereof as depicted in FIG. 6A. Although not depicted, other activation pulses may be generated for the primitives associated the first printhead die (602-1). Further, the other activation pulses may be temporally delayed, via internal delays as described above. As depicted, the first activation pulse (622-1), as well as other activation pulses associated with the first printhead die (602-1), may form a first die power profile (632-1). The first die power profile (632-1) defines a current produced by each of the activation pulses for the first printhead die (602-1). As a result, the first die power profile (632-1) depicts reduced peak power demands of the first printhead die (602-1).

Further, a second activation pulse (622-2) is generated for primitives of the second printhead die (602-2) to activate the nozzles associated with the primitives of FIG. 6A. The second activation pulse (622-2) may be generated via the ASIC (604) and the delay circuitry (112), and generated for the second printhead die (602-2) via bus two (606-2). As depicted, the length of the second activation pulse (622-2) is the same length as the first activation pulse (622-1). As depicted, the second activation pulse (622-2) is delayed via the ASIC (604) and the delay circuitry (112). Although not depicted, other activation pulses may be generated for the primitives associated the second printhead die (602-2). Further, the other activation pulses may be temporally delayed, via internal delays as described above. The internal and external delays delay the second activation pulse (622-2) by 0.33 μS as defined by the time intervals (626) with respect to the first activation pulse (622-1). As depicted, the second activation pulse (622-2), as well as other activation pulses associated with the second printhead die (602-2), may form a second die power profile (632-2). The second die power profile (632-2) defines a current produced by each of the activation pulses for the second printhead die (602-2). As a result, the second die power profile (632-2) depicts reduced peak power demands of the second printhead die (602-2).

A third activation pulse (622-3), fourth activation pulse (622-4), fifth activation pulse (622-5), and sixth activation pulse (622-6) are all generated for their respective primitives of their respective printhead die (602-3, 602-4, 602-5, 602-6) as described above in connection with the first and second activation pulses of FIG. 6B. As to each of the remaining activation pulses (622-3, 622-4, 622-5, 622-6), the internal and external delays delay these activation pulses by 0.33 μS as defined by their respective time intervals (626). As a result, the respective die power profiles (632-3, 632-4, 632-5, 632-6) depict reduced peak power demands of their respective printhead die (602-3, 602-4, 602-5, 602-6).

The die power profiles (632) may be combined as described above and result in a wide array print head power profile (624). The wide array print head power profile (624) depicts that only four fully printhead die are active at any given time. Spreading out the activation pulses (622) reduces transient currents such that coincident transients are minimized, the resultant ringing on the power supply lines of each of the printhead die (602) are minimized, and the space and cost to control the ringing is minimized.

In this example, the first print cycle is defined by solid lines depicted in FIG. 6B. The next print cycle is defined by dotted lines depicted in FIG. 6B. Further, an end (628) of the first print cycle is defined by a dotted line. As a result, the delay associated with the activation pulses (622) is effective and the peak power demands of the printhead die are reduced.

Figure 6C:
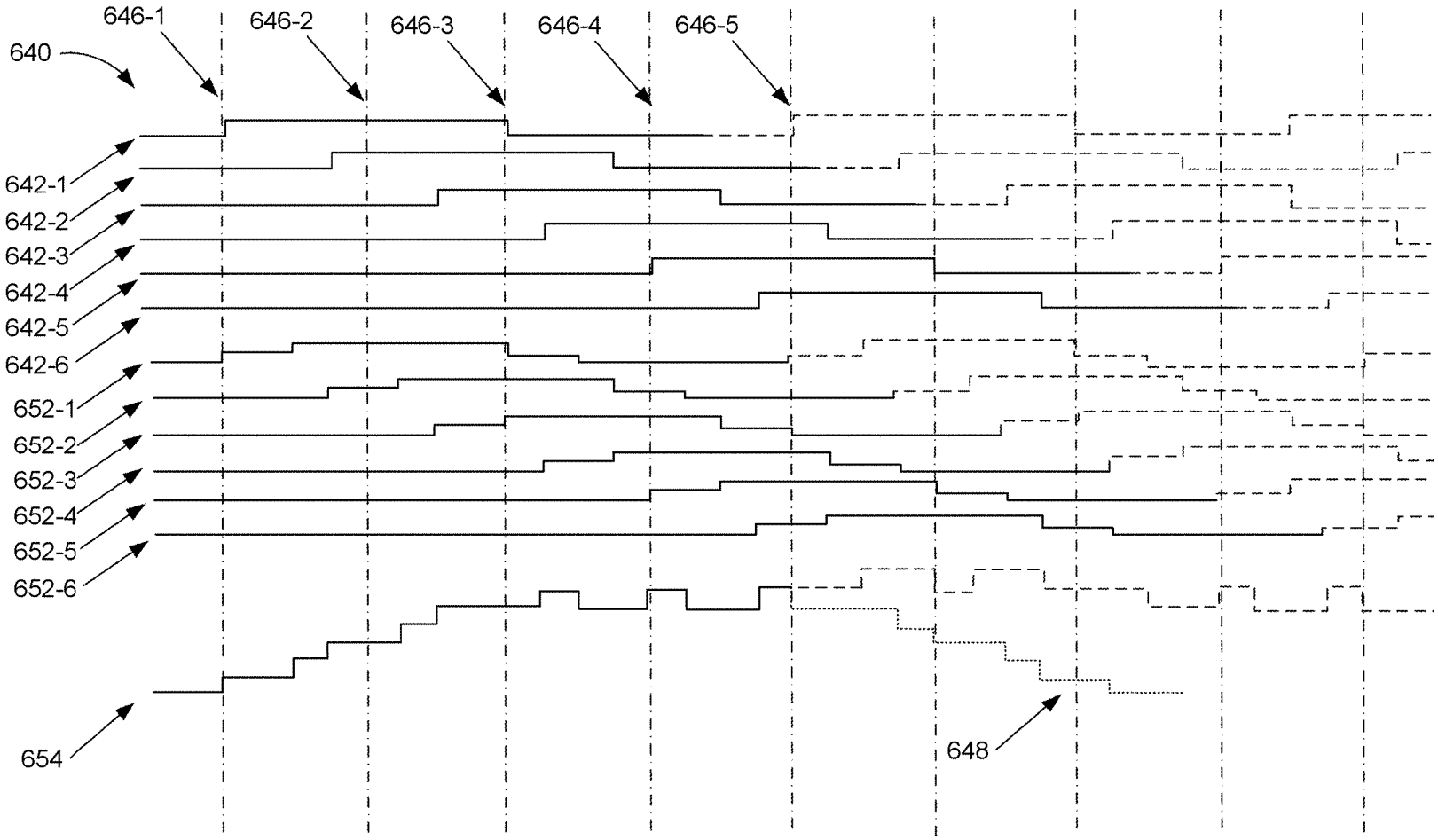
FIG. 6C is a diagram of a waveform for controlling a number of printhead die based on a 0.5 μS delay to reduce peak power demands of the printhead die, according to one example of the principles described herein.

FIG. 6C is a diagram of a timing diagram for controlling a number of printhead die based on a 0.5 microsecond (μS) delay to reduce peak power demands of the printhead die, according to one example of the principles described herein. As will be described below, the ASIC of FIG. 6A controls a number of activation pulses to activate nozzle firing heaters for each of the nozzles associated with each of the primitives of the printhead die.

As depicted in FIG. 6C, first through sixth activation pulse (642-1, 642-2, 642-3, 642-4, 642-5, 642-6) are generated for a respective primitives of their respective printhead die (602-1, 602-2, 602-3, 602-4, 602-5, 602-6) to activate the nozzles associated with their respective primitives of FIG. 6A. The length of the activation pulses (642-1, 642-2, 642-3, 642-4, 642-5, 642-6) may be 1.3 μS as defined by the time intervals (646). Further, the delay between each of the activation pulses (642-1, 642-2, 642-3, 642-4, 642-5, 642-6) is 0.5 μS.

As depicted, the activation pulses (642-1, 642-2, 642-3, 642-4, 642-5, 642-6), as well as other activation pulses associated with their respective printhead die (602-1), may form a respective die power profile (652-1, 652-2, 652-3, 652-4, 652-5, 652-6). The die power profiles (652) define a current produced by each of the activation pulses for their respective printhead die (602-1, 602-2, 602-3, 602-4, 602-5, 602-6). As a result, the die power profiles (652) depict reduced peak power demands of their respective printhead die (602).

The die power profiles (652) may be combined as described above and result in a wide array print head power profile (654). The wide array print head power profile (654) depicts that only three fully active printhead die are active at any given time. Spreading out the activation pulses (642) reduces transient currents such that coincident transients are minimized, the resultant ringing on the power supply lines of each of the printhead die (602) are minimized, and the space and cost to control the ringing is minimized.

In this example, the first print cycle is defined by solid lines depicted in FIG. 6C. The next print cycle is defined by dotted lines depicted in FIG. 6C. Further, an end (648) of the first print cycle is defined by a dotted line. As a result, the delay associated with the activation pulses (642) is effective and the peak power demands of the printhead die are reduced.

Figure 6D:
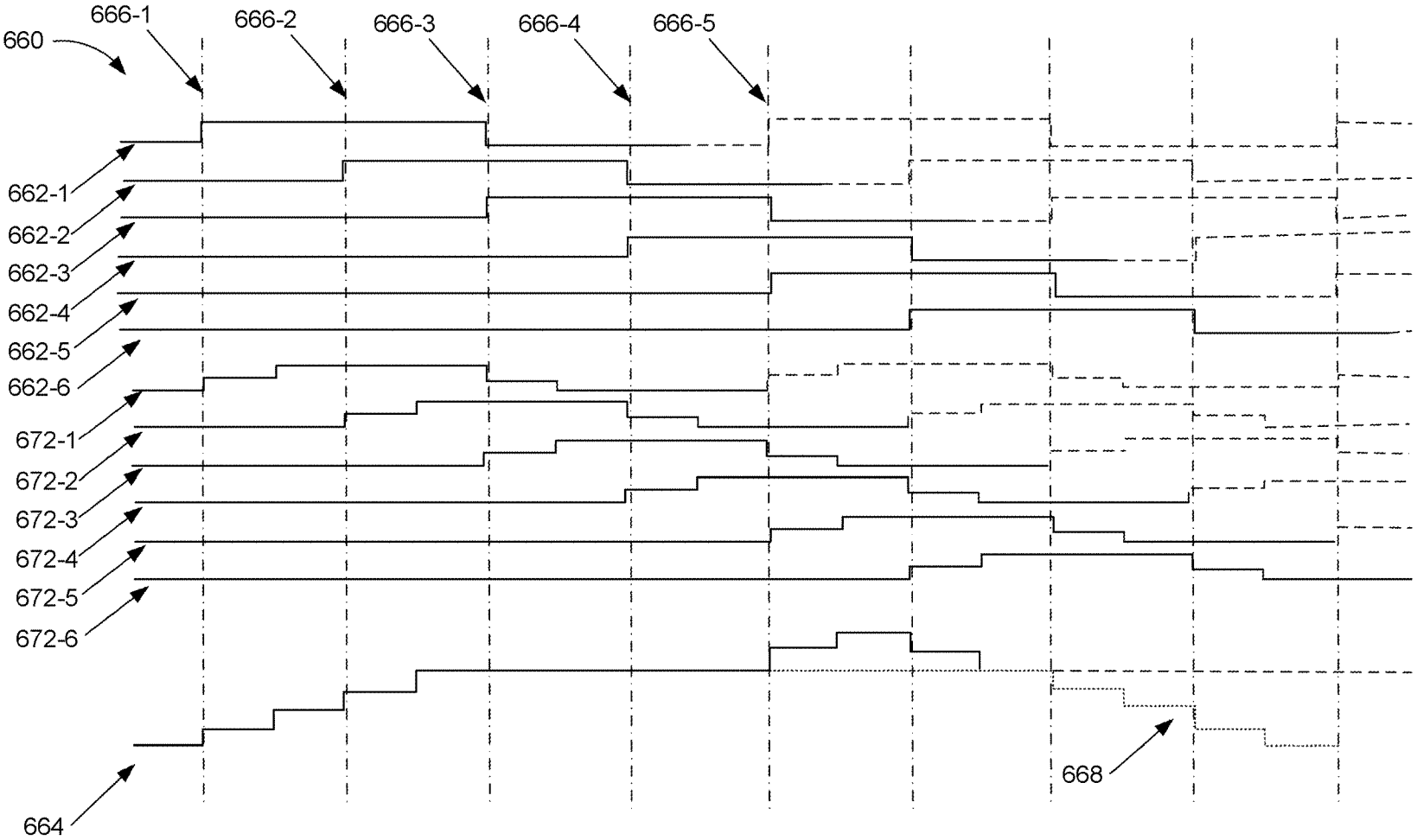
FIG. 6D is a diagram of a waveform for controlling a number of printhead die based on a 0.65 μS delay to reduce peak power demands of the printhead die, according to one example of the principles described herein.

FIG. 6D is a diagram of a timing diagram for controlling a number of printhead die based on a 0.65 μS delay to reduce peak power demands of the printhead die, according to one example of the principles described herein. As will be described below, the ASIC of FIG. 6A controls a number of activation pulses to activate nozzle firing heaters for each of the nozzles associated with each of the primitives of the printhead die.

As depicted in FIG. 6D, first through sixth activation pulse (662-1, 662-2, 662-3, 662-4, 662-5, 662-6) are generated for a respective primitives of their respective printhead die (602-1, 602-2, 602-3, 602-4, 602-5, 602-6) to activate the nozzles associated with their respective primitives of FIG. 6A. The length of the activation pulses (662-1, 662-2, 662-3, 662-4, 662-5, 662-6) may be 1.3 μS as defined by the time intervals (666). Further, the delay between each of the activation pulses (662-1, 662-2, 662-3, 662-4, 662-5, 662-6) is 0.65 μS.

As depicted, the activation pulses (662-1, 662-2, 662-3, 662-4, 662-5, 662-6), as well as other activation pulses associated with their respective printhead die (602-1), may form a respective die power profile (672-1, 672-2, 672-3, 672-4, 672-5, 672-6). The die power profiles (672) define a current produced by each of the activation pulses for their respective printhead die (602-1, 602-2, 602-3, 602-4, 602-5, 602-6). As a result, the die power profiles (672) depict reduced peak power demands of their respective printhead die (602).

The die power profiles (672) may be combined as described above and result in a wide array print head power profile (664). The wide array print head power profile (664) depicts that only two fully active printhead die are active most of the time and only three are active for a short time. Spreading out the activation pulses (662) reduces transient currents such that coincident transients are minimized, the resultant ringing on the power supply lines of each of the printhead die (602) are minimized, and the space and cost to control the ringing is minimized.

In this example, the first print cycle is defined by solid lines depicted in FIG. 6D. The next print cycle is defined by dotted lines depicted in FIG. 6D. Further, an end (668) of the first print cycle is defined by a dotted line. As a result, the delay associated with the activation pulses (662) is effective and the peak power demands of the printhead die are reduced.

Figure 7:
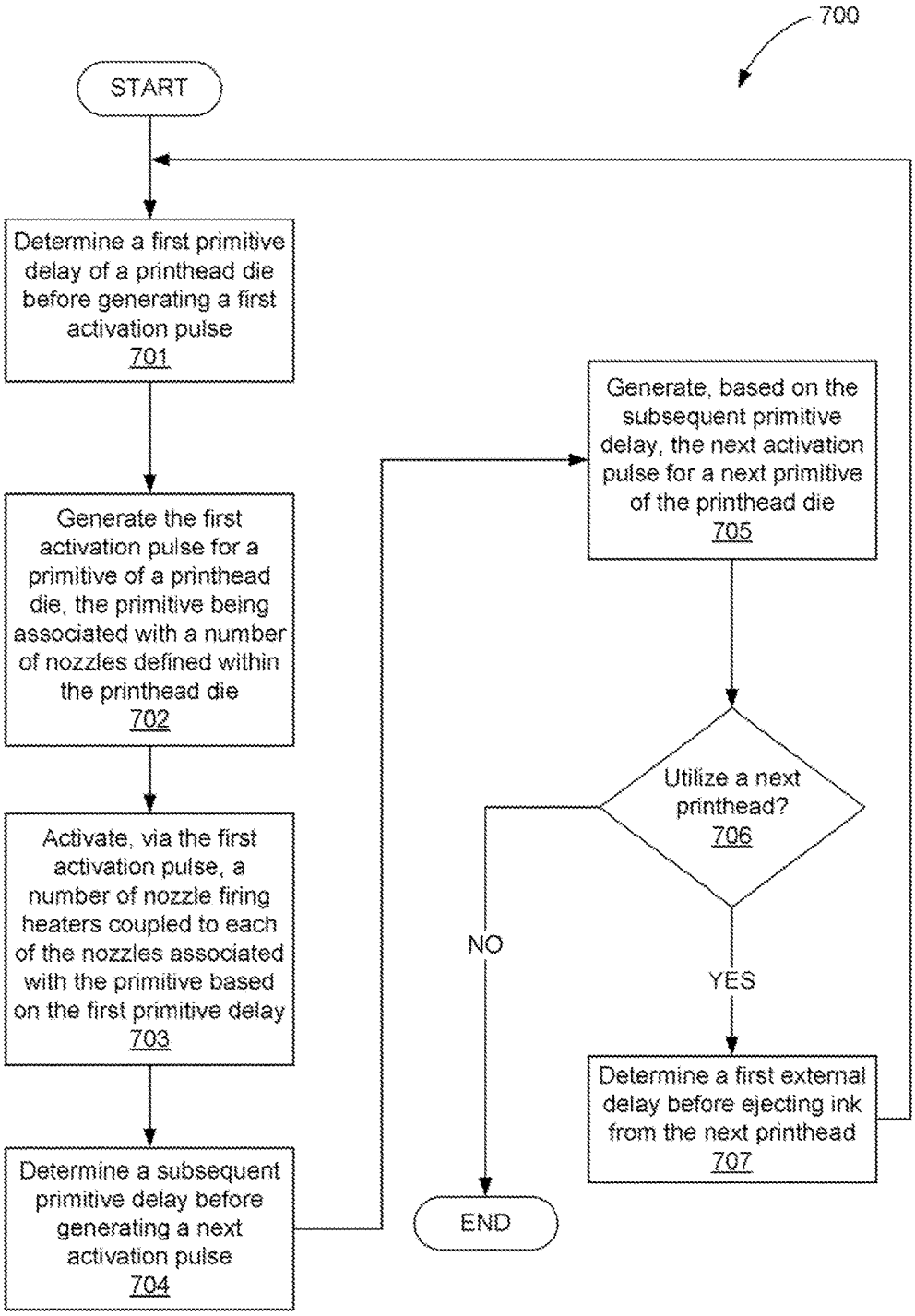
FIG. 7 is a flowchart showing a method of reducing peak power demands of a wide array printhead module, according to another example of the principles described herein.

FIG. 7 is a flowchart showing a method (700) of reducing peak power demands of a wide array printhead module (110), according to another example of the principles described herein. Blocks 701 through 705 proceed as described above in connection with blocks 201 through 205 as described above in connection with FIG. 2. At block 706, the printing device (100) determines if a next printhead is to be utilized to print other portions of a print. If a next printhead is not to be utilized to print other portions of a print (block 706, determination NO), then the method terminates.

If a next printhead is to be utilized to print other portions of a print (block 706, determination YES), then a first external delay before ejection of ink from the next printhead is determined (block 707). The method (700) then loops back to block 701, and an internal delay is determined for the primitives of the next printhead. In this manner, the internal delays may be performed any number of times, and for any number of printheads. Further, external delays may be determined between a number of printheads.

The preceding description has been presented to illustrate and describe examples of the principles described. This description is not intended to be exhaustive or to limit these principles to any precise form disclosed. Many modifications and variations are possible in light of the above teaching.

What is claimed is:

1. A wide array printhead module comprising:

a plurality of printhead die, each of the printhead die comprising:

a number of nozzles to eject ink on a print medium, the number of nozzles forming a number of primitives, each printhead die comprising a plurality of primitives; and a nozzle firing heater coupled to each of the nozzles; and one application specific integrated circuit (ASIC) to control a number of activation pulses that activate the nozzle firing heaters for each of the nozzles associated with the primitives;

in which the activation pulses are delayed between each of the primitives via internal delays and external delays to reduce peak power demands of the printhead die, and in which the ASIC calibrates the internal delays within each printhead die.

2. The wide array printhead module of claim 1, in which the internal delays are controlled via analog or digital elements of the printhead die and the external delays are digitally controlled via the ASIC.

3. The wide array printhead module of claim 1, in which a length of the activation pulses are based on the number of nozzles, the number of primitives, a print demand, or combinations thereof.

4. The wide array printhead module of claim 3, in which the activation pulses comprise a pulse train comprising a number of the activation pulses, in which the sum of the activation pulses form a total activation energy.

5. The wide array printhead module of claim 1, in which the external delays are defined as delays between the ejections of ink between the plurality of printhead die.

6. A printing device comprising:

wide array printhead module comprising:

a plurality of printhead die; and an application specific integrated circuit (ASIC) to:

with a delay circuit, calibrate a number of internal delays within each printhead die; and control activation pulses that activate a number of nozzle firing heaters for each of a number of nozzles, the nozzles being associated with a plurality of primitives, the primitives being defined as groups of the nozzles;

in which the activation pulses are delayed between each of the primitives via the internal delays and a number of external delays to reduce peak power demands of the printhead die.

7. The printing device of claim 6, in which the internal delays are controlled via analog elements of the printhead die and the external delays are digitally controlled via the ASIC.

8. The printing device of claim 6, in which a length of the activation pulses are based on the number of nozzles, the number of primitives, a print demand, or combinations thereof.

9. The printing device of claim 6, in which the activation pulses comprises a number of precursor pulses and a number of activation pulses, the precursor pulses activating the nozzle firing heater to warm the ink and the activation pulses activating the nozzle firing heater to boil the ink.

10. The printing device of claim 6, in which the external delays are defined as delays between the ejections of ink between the plurality of printhead die.

11. A method of reducing peak power demands of a wide array printhead module comprising:

with an application specific integrated circuit (ASIC):

determining a first primitive delay of a printhead die before generating a first activation pulse;

generating the first activation pulse for a primitive of the printhead die, the primitive being associated with a number of nozzles defined within the printhead die, each printhead die comprising a plurality of primitives;

activating, via the first activation pulse, a number of nozzle firing heaters coupled to each of the nozzles associated with the primitive based on the primitive delay;

determining a subsequent primitive delay before generating a next activation pulse; and generating, based on the subsequent primitive delay, the next activation pulse for a next primitive of the printhead die.

12. The method of claim 11, in which a length of the first activation pulse and the next activation pulse is based on the number of nozzles, a number of the primitives, a print demand, or combinations thereof.

13. The method of claim 12, in which the delay is based on internal delays of analog elements of the printhead die and external delays controlled via the ASIC, in which the external delays are defined as delays between the ejections of ink between the plurality of printhead die.

14. The method of claim 11, in which the delay for the next activation pulse is temporally distorted such that the delay reduces the peak power demands of the printhead die by:

minimizing coincident transients; and minimizing ringing on power supply lines.

15. The method of claim 11, in which the first activation pulse and next activation pulse comprise a single voltage pulse or a number of voltage pulses.

16. The method of claim 11, comprising determining if a next printhead is to be utilized.

17. The method of claim 16, wherein if the next printhead is to be utilized, determining a first external delay before ejection of an ink from the next printhead.

* * * * *